US007072832B1

(12) United States Patent
Su et al.

(10) Patent No.: US 7,072,832 B1
(45) Date of Patent: Jul. 4, 2006

(54) SYSTEM FOR SPEECH ENCODING HAVING AN ADAPTIVE ENCODING ARRANGEMENT

(75) Inventors: Huan-Yu Su, San Clemente, CA (US); Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 973 days.

(21) Appl. No.: 09/663,002

(22) Filed: Sep. 15, 2000

Related U.S. Application Data

(63) Continuation-in-part of application No. 09/154,660, filed on Sep. 18, 1998, now Pat. No. 6,330,533.
(60) Provisional application No. 60/097,569, filed on Aug. 24, 1998.

(51) Int. Cl.
*G10L 19/00* (2006.01)

(52) U.S. Cl. ..... 704/230; 704/223
(58) Field of Classification Search ..... 704/230, 704/219, 223, 207
See application file for complete search history.

(56) References Cited

U.S. PATENT DOCUMENTS

| | | | | | |
|---|---|---|---|---|---|
| 4,969,192 | A | | 11/1990 | Chen et al. | 704/222 |
| 5,596,676 | A | * | 1/1997 | Swaminathan et al. | 704/208 |
| 5,657,420 | A | | 8/1997 | Jacobs et al. | 395/2.32 |
| 5,732,188 | A | | 3/1998 | Moriya | 704/219 |
| 5,732,389 | A | | 3/1998 | Kroon et al. | 704/223 |

FOREIGN PATENT DOCUMENTS

| | | |
|---|---|---|
| WO | 92/22891 | 12/1992 |
| WO | 95/28824 | 11/1995 |

OTHER PUBLICATIONS

Gerhard Schroeder, "International Telecommunication Union Telecommunications Standardization Sector," Jun. 1995, pp. i–iv, 1–142.
"Digital Cellular Telecommunications System; Comfort Noise Aspects for Enhanced Full Rate (EFR) Speech Traffic Channels (GSM 06.62)," May 1996, pp. 1–16.
W.B. Kleijn and K.K. Paliwal (Editors), Speech Coding and Synthesis, Elsevier Science B.V.; Kroon and W.B. Kleijn (Authors), Chapter 3: "Linear–Prediction Based on Analysis–by–Synthesis Coding," 1995, pp. 81–113.

(Continued)

*Primary Examiner*—W. R. Young
*Assistant Examiner*—Michael N. Opsasnick
(74) *Attorney, Agent, or Firm*—Farjami & Farjami LLP

(57) ABSTRACT

In accordance with one aspect of the invention, a selector supports the selection of a first encoding scheme or the second encoding scheme based upon the detection or absence of the triggering characteristic in the interval of the input speech signal. The first encoding scheme has a pitch pre-processing procedure for processing the input speech signal to form a revised speech signal biased toward an ideal voiced and stationary characteristic. The pre-processing procedure allows the encoder to fully capture the benefits of a bandwidth-efficient, long-term predictive procedure for a greater amount of speech components of an input speech signal than would otherwise be possible. In accordance with another aspect of the invention, the second encoding scheme entails a long-term prediction mode for encoding the pitch on a sub-frame by sub-frame basis. The long-term prediction mode is tailored to where the generally periodic component of the speech is generally not stationary or less than completely periodic and requires greater frequency of updates from the adaptive codebook to achieve a desired perceptual quality of the reproduced speech under a long-term predictive procedure.

57 Claims, 7 Drawing Sheets

| ENCODING SCHEME | FIRST ENCODING SCHEME 99 | | SECOND ENCODING SCHEME 97 | |
|---|---|---|---|---|
| FRAME DURATION | 20 ms | | 20 ms | |
| FRAME TYPE | 1ST FRAME TYPE (4 SUBFRAMES) | | 2ND FRAME TYPE (4 SUBFRAMES) | |
| FILTER COEFFICIENT 76 INDICATORS (E.G., LSF'S) | 1ST STAGE<br>2ND STAGE<br>3RD STAGE<br>4TH STAGE | 7 BITS<br>6 BITS<br>6 BITS<br>6BITS<br>25 BITS | INTERPOLATION<br>1ST STAGE<br>2ND STAGE<br>3RD STAGE<br>4TH STAGE | 2 BIT<br>7 BITS<br>6 BITS<br>6 BITS<br>6BITS<br>27 BITS |
| TYPE INDICATOR 71 | | 1 BIT | 1 BIT | |
| ADAPTIVE CODEBOOK 72 | 8 BITS/FRAME | 8 BITS | 8,5,8,5 BITS/SUBFRAME | 26 BITS |
| FILTER CODEBOOK 74 INDEX | 8 - PULSE CODEBOOK $2^{30}$ ENT./SUBFRAME | | 5 - PULSE CODEBOOK<br>5 - PULSE CODEBOOK<br>5 - PULSE CODEBOOK | $2^{21}$ ENT./SUBFRAME<br>$2^{20}$ ENT./SUBFRAME<br>$2^{20}$ ENT./SUBFRAME<br>$2^{22}$ ENT./SUBFRAME |
| 80 | 30 BITS/SUBFRAME | 120 BITS | 22 BITS/SUBFRAME | 88 BITS |
| ADAPTIVE CODEBOOK GAIN | 4D PRE VQ/FRAME | 6 BITS | 2D VQ/SUBFRAME | 7 BITS/SUBFRAME 28 BITS |
| FIXED CODEBOOK GAIN 78 | 4D DELAYED VQ/FRAME | 10 BITS | | |
| TOTAL BITS | 170 BITS | | 170 BITS | |

U.S. PATENT DOCUMENTS

| | | | | | |
|---|---|---|---|---|---|
| 5,778,338 | A | * | 7/1998 | Jacobs et al. | 704/223 |
| 5,960,389 | A | * | 9/1999 | Jarvinen et al. | 704/220 |
| 6,006,177 | A | | 12/1999 | Funaki | 704/220 |
| 6,052,661 | A | | 4/2000 | Yamaura et al. | 704/222 |
| 6,067,518 | A | | 5/2000 | Morii | 704/262 |
| 6,073,092 | A | | 6/2000 | Kwon | 704/219 |
| 6,104,992 | A | * | 8/2000 | Gao et al. | 704/220 |
| 6,173,257 | B1 | * | 1/2001 | Gao | 704/220 |
| 6,188,980 | B1 | * | 2/2001 | Thyssen | 704/230 |
| 6,233,550 | B1 | * | 5/2001 | Gersho et al. | 704/208 |
| 6,260,010 | B1 | * | 7/2001 | Gao et al. | 704/230 |
| 6,330,533 | B1 | * | 12/2001 | Su et al. | 704/220 |
| 6,636,829 | B1 | * | 10/2003 | Benyassine et al. | 704/201 |

OTHER PUBLICATIONS

W.B. Kleijn and K.K. Paliwal (Editors), Speech Coding and Synthesis, Elsevier Science B.V.; A. Das, E. Paskoy and A. Gersho (Authors), Chapter 7: "Multimode and Variable–Rate Coding of Speech," 1995, pp. 257–288.

B.S. Atal, V. Cuperman, and A. Gersho (Editors), Speech and Audio Coding for Wireless and Network Applications, Kluwer Academic Publishers; T. Taniguchi, Y. Tanaka and Y. Ohta (Authors), Chapter 27: "Structured Stochastic Codebook and Codebook Adaptation for CELP," 1993, pp. 217–224.

W. Bastiaan Kleijn and Peter Kroon, The RCELP Speech–Coding Algorithm, vol. 5, No. 5, Sept.–Oct. 1994, pp. 39/573–47/581.

C. Laflamme, J–P. Adoul, H.Y. Su, and S. Morissette, On Reducing Computational Complexity of Codebook Search in CELP Coder Through the Use of Algebraic Codes, 1990, pp. 177–180.

Chih–Chung Kuo, Fu–rong Jean, and Hsiao–Chuan Wang, Speech Classification Embedded in Adaptive Codebook Search for Low Bit–Rate CELP Coding, IEEE Transactions on Speech and Audio Processing, vol. 3, No. 1, Jan. 1995, pp. 1–5.

Erdal Paksoy, Alan McCree, and Vish Viswanathan, A Variable–Rate Multimodal Speech Coder with Gain–Matched Analysis–By–Synthesis, 1997, pp. 751–754.

Gerhard Schroeder, International Telecommunication Union Telecommunications Standardization Sector, Jun. 1995, pp. i–iv, 1–42.

Digital Cellular Telecommunications System; Comfort Noise Aspects for Enhanced Full Rate (EFR) Speech Traffic Channels (GSM 06.62), May 1996, pp. 1–16.

W.B. Kleijn and K.K. Paliwal (Editors), Speech Coding and Synthesis, Elsevier Science B.V.; Kroon and W.B. Kleijn (Authors), Chapter 3, Linear–Prediction Based on Analysis–by–Synthesis Coding, 1995, pp. 81–113.

W.B. Kleijn and K.K. Paliwal (Editors), Speech Coding and Synthesis, Elsevier Science B.V.; A. Das, E. Paskoy and A. Gersho (Authors), Chapter 7, Multimode and Variable–Rate Coding of Speech, 1995, pp. 257–288.

B.S. Atal, V. Cuperman, and A. Gersho (Editors), Speech and Audio Coding for Wireless and Network Applications, Kluwer Academic Publishers; T. Taniguchi, Y. Tanaka and Y. Ohta (Authors), Chapter 27, Structured Stochastic Codebook Adaptation for CELP, 1993, pp. 217–224.

B.S. Atal, V. Cuperman, and A. Gersho (Editors), Advances in Speech Coding, Kluwer Academic Publishers; I.A. Gerson and M.A. Jasiuk (Authors), Chapter 7, Vector Sum Excited Linear Prediction (VSELP), pp. 69–79.

B.S. Atal, V. Cuperman, and A. Gersho (Editors), Advances in Speech Coding, Kluwer Academic Publishers; J.P. Campbell, Jr., T.E. Tremain, and V.C. Welch (Authors), Chapter 12, The DOD 4.8 KBPS Standard (Proposed Federal Standard 1016), 1999, pp. 121–133.

B.S. Atal, V. Cuperman, and A. Gersho (Editors), Advances in Speech Coding, Kluwer Academic Publishers; R.A. Salami (Author), Chapter 14, Binary Pulse Excitation: A Novel Approach to Low Complexity CELP Coding, 1991, pp. 145–157.

Lawrence R. Rabiner and Ronald W. Schafer, Digital Processing Of Speech Signals, pp. 1–37 and 396–461.

W. Bastiaan Kleijn and Peter Kroon, "The RCELP Speech–Coding Algorithm," vol. 5, No. 5, Sept.–Oct. 1994, pp. 39/573–47/581.

C. Laflamme, J–P. Adoul, H.Y. Su, and S. Morissette, "On Reducing Computational Complexity of Codebook Search in CELP Coder Through the Use of Algebraic Codes," 1990, pp. 177–180.

Chih–Chung Kuo, Fu–Rong Jean, and Hsiao–Chuan Wang, "Speech Classification Embedded in Adaptive Codebook Search for Low Bit–Rate CELP Coding," IEEE Transactions on Speech and Audio Processing, vol. 3, No. 1, Jan. 1995, pp. 1–5.

Erdal Paksoy, Alan McCree, and Vish Viswanathan, "A Variable–Rate Multimodal Speech Coder with Gain–Matched Analysis–By–Synthesis," 1997, pp. 751–754.

Kazunori Ozawa and Taskashi Araseki, "*Multipulse Excited Speech Coding Utilizing Pitch Information at Rates Between 9.6 and 4.8 kbits/s*", Systems and Computers in Japan, vol. 21 No. 13, 1990.

S. Ghaemmaghami and M. Deriche, "*A New Approach to Efficient Interpolative Determination of Pitch Contour Using Temporal Decomposition*", IEEE Proceedings of Digital Processing Application, 1996, pp. 125–130.

Roch Lefebvre and Claude LaFlamme, "*Shaping Coding Noise With Frequency–Domain Companding*", IEEE publication, 1997, pp 61–62.

W. Bastiaan Klejian, Ravi P. Ramachandran and Peter Kroon, "*Generalized Analysis–By–Synthesis Coding and Its Application To Pitch Prediction*", IEEE, 1992, pp 1–337—1–340.

W. Bastiaan Klejian, Ravi P. Ramachandran and Peter Kroon, "*Interpolation of the Pitch–Predictor Parameters in Analysis–by–Synthesis Speech Coders*", IEEE Transactions on Speech and Audio Processing, vol. 2, No. 1, Part 1, 1994, pp 42–54.

* cited by examiner

| ENCODING SCHEME | FIRST ENCODING SCHEME 99 | | SECOND ENCODING SCHEME 97 | |
|---|---|---|---|---|
| FRAME DURATION | 20 ms | | 20 ms | |
| FRAME TYPE | 1ST FRAME TYPE (4 SUBFRAMES) | | 2ND FRAME TYPE (4 SUBFRAMES) | |
| FILTER COEFFICIENT INDICATORS (E.G., LSF'S) 76 | 1ST STAGE<br>2ND STAGE<br>3RD STAGE<br>4TH STAGE | 7 BITS<br>6 BITS<br>6 BITS<br>6BITS<br>25 BITS | INTERPOLATION<br>1ST STAGE<br>2ND STAGE<br>3RD STAGE<br>4TH STAGE | 2 BIT<br>7 BITS<br>6 BITS<br>6 BITS<br>6BITS<br>27 BITS |
| TYPE INDICATOR 71 | | 1 BIT | 1 BIT | |
| ADAPTIVE CODEBOOK 72 | 8 BITS/FRAME | 8 BITS | 8,5,8,5 BITS/SUBFRAME | 26 BITS |
| FILTER CODEBOOK INDEX 74 | 8 - PULSE CODEBOOK $2^{30}$ ENT./SUBFRAME | | 5 - PULSE CODEBOOK<br>5 - PULSE CODEBOOK<br>5 - PULSE CODEBOOK | $2^{21}$ ENT./SUBFRAME<br>$2^{20}$ ENT./SUBFRAME<br>$2^{20}$ ENT./SUBFRAME<br>$2^{22}$ ENT./SUBFRAME |
| 80 | 30 BITS/SUBFRAME | 120 BITS | 22 BITS/SUBFRAME | 88 BITS |
| ADAPTIVE CODEBOOK GAIN | 4D PRE VQ/FRAME | 6 BITS | 2D VQ/SUBFRAME | 7 BITS/SUBFRAME<br>28 BITS |
| FIXED CODEBOOK GAIN 78 | 4D DELAYED VQ/FRAME | 10 BITS | | |
| TOTAL BITS | 170 BITS | | 170 BITS | |

FIG. 6

| ENCODING SCHEME | THIRD ENCODING SCHEME —103 | | FOURTH ENCODING SCHEME —101 | |
|---|---|---|---|---|
| FRAME DURATION | 20 ms | | 20 ms | |
| FRAME TYPE | 3RD FRAME TYPE (3 SUBFRAMES) | | 4TH FRAME TYPE (2 SUBFRAMES) | |
| LSF'S FILTER COEFFICIENT INDICATORS (E.G., LSF'S) —76 | 1 BIT<br>7 BITS<br>7 BITS<br>6 BITS<br>21 BITS | | PREDICTOR SWITCH<br>$1^{ST}$ STAGE<br>2 STAGE<br>$3^{RD}$ STAGE | |
| TYPE INDICATOR —71 | 1 BIT | | 1 BIT | |
| ADAPTIVE CODEBOOK —72 | 7 BITS/FRAME | 7 BITS | 7 BITS/SUBFRAME | 14 BITS |
| FIXED CODEBOOK INDEX 74 | 2 - PULSE CODEBOOK<br>3 - PULSE CODEBOOK | $2^{12}$ ENT./SUBFRAME<br>$2^{12}$ ENT./SUBFRAME<br>$2^{13}$ ENT./SUBFRAME | 2 - PULSE CODEBOOK<br>3 - PULSE CODEBOOK<br>GAUSSIAN CODEBOOK | $2^{14}$ ENT./SUBFRAME<br>$2^{13}$ ENT./SUBFRAME<br>$2^{13}$ ENT./SUBFRAME<br>$2^{15}$ ENT./SUBFRAME |
| —80 | 13 BITS/SUBFRAME | 39 BITS | 15 BITS/SUBFRAME | 30 BITS |
| ADAPTIVE CODEBOOK GAIN | 3D PRE VQ/FRAME | 4 BITS | 2D VQ/SUBFRAME | 7 BITS/SUBFRAME<br>14 BITS |
| FIXED CODEBOOK GAIN 78 | 3D DELAYED VQ/FRAME | 8 BITS | | |
| TOTAL BITS | 80 BITS | | 80 BITS | |

FIG. 7

SYSTEM FOR SPEECH ENCODING HAVING AN ADAPTIVE ENCODING ARRANGEMENT

CROSS REFERENCE TO RELATED APPLICATIONS

This application claims the benefit of provisional application Ser. No. 60/097,569 filed Aug. 24, 1998.

This application is a continuation-in-part of application Ser. No. 09/154,660, filed on Sep. 18, 1998. The following U.S. Pat. No. 6,330,533 and commonly assigned U.S. patent applications have been filed on the same day as this application. All of these applications relate to and further describe other aspects of the embodiments disclosed in this application and are incorporated by reference in their entirety.

U.S. patent application Ser. No. 09/663,242 "SELECTABLE MODE VOCODER SYSTEM," filed on Sep. 15, 2000.

U.S. patent application Ser. No. 09/755,441 "INJECTING HIGH FREQUENCY NOISE INTO PULSE EXCITATION FOR LOW BIT RATE CELP," filed on Sep. 15, 2000.

U.S. patent application Ser. No. 09/771,293 "SHORT TERM ENHANCEMENT IN CELP SPEECH CODING," filed on Sep. 15, 2000.

U.S. patent application Ser. No. 09/761,029 "SYSTEM OF DYNAMIC PULSE POSITION TRACKS FOR PULSE-LIKE EXCITATION IN SPEECH CODING," filed on Sep. 15, 2000.

U.S. patent application Ser. No. 09/782,791 "SPEECH CODING SYSTEM WITH TIME-DOMAIN NOISE ATTENUATION," filed on Sep. 15, 2000.

U.S. patent application Ser. No. 09/761,033 "SYSTEM FOR AN ADAPTIVE EXCITATION PATTERN FOR SPEECH CODING," filed on Sep. 15, 2000.

U.S. patent application Ser. No. 09/782,383 "SYSTEM FOR ENCODING SPEECH INFORMATION USING AN ADAPTIVE CODEBOOK WITH DIFFERENT RESOLUTION LEVELS," filed on Sep. 15, 2000.

U.S. patent application Ser. No. 09/663,837 "CODEBOOK TABLES FOR ENCODING AND DECODING," filed on Sep. 15, 2000.

U.S. patent application Ser. No. 09/662,828 "BIT STREAM PROTOCOL FOR TRANSMISSION OF ENCODED VOICE SIGNALS," filed on Sep. 15, 2000.

U.S. patent application Ser. No. 09/781,735 "SYSTEM FOR FILTERING SPECTRAL CONTENT OF A SIGNAL FOR SPEECH ENCODING," filed on Sep. 15, 2000.

U.S. patent application Ser. No. 09/663,734 "SYSTEM FOR ENCODING AND DECODING SPEECH SIGNALS," filed on Sep. 15, 2000.

U.S. patent application Ser. No. 09/940,904 "SYSTEM FOR IMPROVED USE OF PITCH ENHANCEMENT WITH SUBCODEBOOKS," Sep. 15, 2000.

BACKGROUND OF THE INVENTION

1. Technical Field

This invention relates to a method and system having an adaptive encoding arrangement for coding a speech signal.

2. Related Art

Speech encoding may be used to increase the traffic handling capacity of an air interface of a wireless system. A wireless service provider generally seeks to maximize the number of active subscribers served by the wireless communications service for an allocated bandwidth of electromagnetic spectrum to maximize subscriber revenue. A wireless service provider may pay tariffs, licensing fees, and auction fees to governmental regulators to acquire or maintain the right to use an allocated bandwidth of frequencies for the provision of wireless communications services. Thus, the wireless service provider may select speech encoding technology to get the most return on its investment in wireless infrastructure.

Certain speech encoding schemes store a detailed database at an encoding site and a duplicate detailed database at a decoding site. Encoding infrastructure transmits reference data for indexing the duplicate detailed database to conserve the available bandwidth of the air interface. Instead of modulating a carrier signal with the entire speech signal at the encoding site, the encoding infrastructure merely transmits the shorter reference data that represents the original speech signal. The decoding infrastructure reconstructs a replica or representation of the original speech signal by using the shorter reference data to access the duplicate detailed database at the decoding site.

The quality of the speech signal may be impacted if an insufficient variety of excitation vectors are present in the detailed database to accurately represent the speech underlying the original speech signal. The maximum number of code identifiers (e.g., binary combinations) supported is one limitation on the variety of excitation vectors that may be represented in the detailed database (e.g., codebook). A limited number of possible excitation vectors for certain components of the speech signal, such as short-term predictive components, may not afford the accurate or intelligible representation of the speech signal by the excitation vectors. Accordingly, at times the reproduced speech may be artificial-sounding, distorted, unintelligible, or not perceptually palatable to subscribers. Thus, a need exists for enhancing the quality of reproduced speech, while adhering to the bandwidth constraints imposed by the transmission of reference or indexing information within a limited number of bits.

SUMMARY

An encoder supports a first encoding scheme and a second encoding scheme for one or more frames of a speech signal. The first and second encoding schemes define the data structure per frame or the data structure per subframe that is transmitted from the encoder over an air interface of a wireless system. The data structures of successive frames or groups of frames may affect the perceptual quality of the speech signal and an overall coding rate for a channel of an air interface of a wireless system. An adaptive encoding arrangement refers to the selection of an encoding scheme based upon an analysis or check of an input speech signal and coding (e.g., pitch pre-processing) the input speech signal pursuant to the selected encoding scheme. For example, the adaptive encoding arrangement may relate to the selection of and execution of the first encoding scheme or the second encoding scheme for encoding one or more frames of a speech signal based upon an analysis or check of an input speech signal.

A detector detects whether a speech signal has a triggering characteristic (e.g., a generally voiced and generally stationary component) during an interval. A selector selects the first encoding scheme or the second encoding scheme to encode a frame associated with the interval based upon the detection or absence of the triggering characteristic. For example, if the speech signal has the triggering characteristic during the interval, an encoder may encode the speech signal in a frame associated with the interval in accordance with a first encoding scheme.

The first encoding scheme has a pitch pre-processing procedure for processing the input speech signal to form a revised speech signal biased toward an ideal voiced and stationary characteristic. The pitch pre-processing procedure allows the encoder to fully capture the benefits of a bandwidth-efficient, long-term predictive procedure for a greater amount of speech components of an input speech signal than would otherwise be possible. The pitch pre-processing procedure forms a revised speech signal from somewhat stationary and voiced input speech components. The revised speech signal has a substantially stationary and substantially voiced quality that facilitates the efficient bit-usage per frame of a long-term predictive coding procedure applicable to substantially voiced and stationary input speech components, while preserving a target perceptual quality of the speech.

By slightly favoring the adaptive codebook for more speech components of the input speech signal, the pitch pre-processing procedure is well-suited for reducing the requisite minimum bandwidth or transmission rate of the transmission of information over the air interface without sacrificing noticeable or material degradation in perceptual quality of the speech signal. In accordance with one aspect of the invention, long-term predictive components of a substantially stationary and voiced input speech signal may be represented adequately by a lesser number of excitation vectors in an adaptive codebook, than the short-term predictive components require in a fixed codebook. Thus, the encoder may use the surplus bits saved by the pitch pre-processing procedure and subsequent coding to offer a different allocation of bits in a frame to improve the accuracy or resolution of a fixed codebook for short-term predictive components, residual speech components, or both.

In accordance with another aspect of the invention, the second encoding scheme entails a long-term prediction mode for encoding the pitch on a sub-frame by sub-frame basis. The long-term prediction mode is tailored to where the generally periodic component of the speech is generally not stationary or less than completely periodic and requires greater frequency of updates from the adaptive codebook to achieve a desired perceptual quality of the reproduced speech under a long-term predictive procedure.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. Like reference numerals designate corresponding parts or procedures throughout the different figures.

FIG. 6 and FIG. 7 are charts of bit assignments for an illustrative higher rate encoding scheme and a lower rate encoding scheme, respectively.

DETAILED DESCRIPTION OF PREFERRED EMBODIMENTS

A multi-rate encoder may include different encoding schemes to attain different transmission rates over an air interface. Each different transmission rate may be achieved by using one or more encoding schemes. The highest coding rate may be referred to as full-rate coding. A lower coding rate may be referred to as one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities or objective similarities between the original speech signal and the synthesized speech signal. A code-excited linear predictive coding scheme (CELP) is one example of an analysis-by synthesis encoding scheme.

Figure 1:
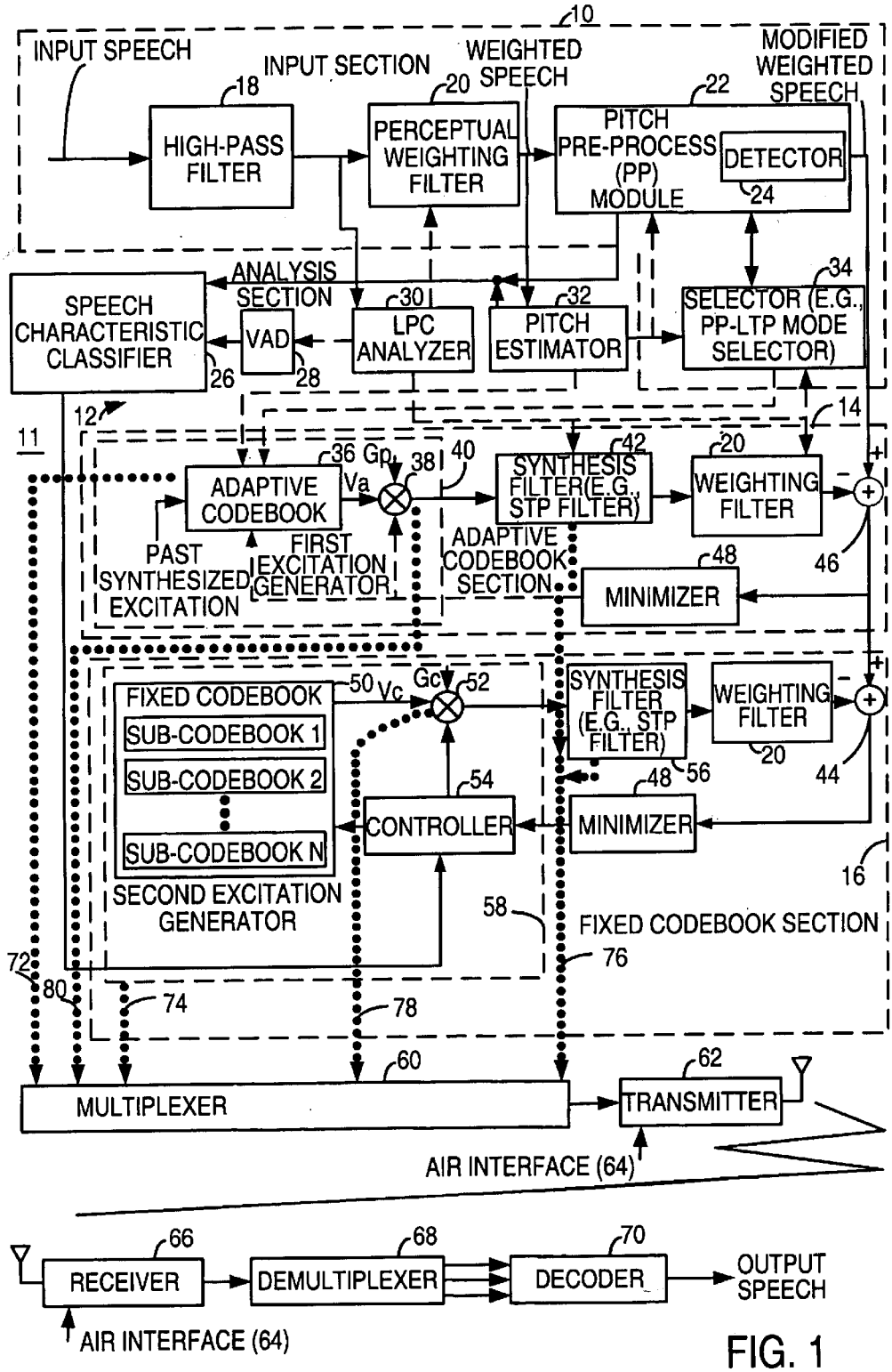
FIG. 1 is a block diagram of an illustrative embodiment of an encoder and a decoder.

In accordance with the invention, FIG. 1 shows an encoder 11 including an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 66 along with a communications protocol represent an air interface 64 of a wireless system. The input speech from a source or speaker is applied to the encoder 11 at the encoding site. The transmitter 62 transmits an electromagnetic signal (e.g., radio frequency or microwave signal) from an encoding site to a receiver 66 at a decoding site, which is remotely situated from the encoding site. The electromagnetic signal is modulated with reference information representative of the input speech signal. A demultiplexer 68 demultiplexes the reference information for input to the decoder 70. The decoder 70 produces a replica or representation of the input speech, referred to as output speech, at the decoder 70.

The input section 10 has an input terminal for receiving an input speech signal. The input terminal feeds a high-pass filter 18 that attenuates the input speech signal below a cut-off frequency (e.g., 80 Hz) to reduce noise in the input speech signal. The high-pass filter 18 feeds a perceptual weighting filter 20 and a linear predictive coding (LPC) analyzer 30. The perceptual weighting filter 20 may feed both a pitch pre-processing module 22 and a pitch estimator 32. Further, the perceptual weighting filter may be coupled to an input of a first summer 46 via the pitch pre-processing module 22. The pitch pre-processing module 22 includes a detector 24 for detecting a triggering speech characteristic.

In one embodiment, the detector 24 may refer to a classification unit that (1) identifies noise-like unvoiced speech and (2) distinguishes between non-stationary voiced and stationary voiced speech in an interval of an input speech signal. The detector 24 may detect or facilitate detection of the presence or absence of a triggering characteristic (e.g., a generally voiced and generally stationary speech component) in an interval of input speech signal. In another embodiment, the detector 24 may be integrated into both the pitch pre-processing module 22 and the speech characteristic classifier 26 to detect a triggering characteristic in an interval of the input speech signal. In yet another embodiment, the detector 24 is integrated into the speech characteristic classifier 26, rather than the pitch pre-processing module 22. Where the detector 24 is so integrated, the speech characteristic classifier 26 is coupled to a selector 34.

The analysis section 12 includes the LPC analyzer 30, the pitch estimator 32, a voice activity detector 28, and a speech characteristic classifier 26. The LPC analyzer is coupled to the voice activity detector 28 for detecting the presence of speech or silence in the input speech signal. The pitch estimator 32 is coupled to a mode selector 34 for selecting a pitch pre-processing procedure or a responsive long-term prediction procedure based on input received from the detector 24.

The adaptive codebook section 14 includes a first excitation generator 40 coupled to a synthesis filter 42 (e.g., short-term predictive filter). In turn, the synthesis filter 42 feeds a perceptual weighting filter 20. The weighting filter 20 is coupled to an input of the first summer 46, whereas a minimizer 48 is coupled to an output of the first summer 46. The minimizer 48 provides a feedback command to the first excitation generator 40 to minimize an error signal at the output of the first summer 46. The adaptive codebook section 14 is coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-term predictive filter). In turn, the synthesis filter 42 feeds a perceptual weighting filter 20. The weighting filter 20 is coupled to an input of the second summer 44, whereas a minimizer 48 is coupled to an output of the second summer 44. A residual signal is present on the output of the second summer 44. The minimizer 48 provides a feedback command to the second excitation generator 58 to minimize the residual signal.

In one alternate embodiment, the synthesis filter 42 and the perceptual weighting filter 20 of the adaptive codebook section 14 are combined into a single filter.

In another alternate embodiment, the synthesis filter 42 and the perceptual weighting filter 20 of the fixed codebook section 16 are combined into a single filter.

In yet another alternate embodiment, the three perceptual weighting filters 20 of the encoder may be replaced by two perceptual weighting filters 20, where each perceptual weighting filter 20 is coupled in tandem with the input of one of the minimizers 48. Accordingly, in the foregoing alternate embodiment the perceptual weighting filter 20 from the input section 10 is deleted.

In accordance with FIG. 1, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoder 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The perceptual weighing filter 20 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The perceptual weighting filter 20 is adjusted to compensate for the perceptually induced deficiencies in error minimization, which would otherwise result, between the reference speech signal (e.g., input speech signal) and a synthesized speech signal.

The input speech signal is provided to a linear predictive coding (LPC) analyzer (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 1, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36. The adaptive codebook section 11 later refines the estimated representative pitch lag to select an optimum or preferential excitation vector from the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Nonstationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. A speech classifier may accept a raw input speech signal, pitch lag, pitch correlation data, and voice activity detector data to classify the raw speech signal as one of the foregoing classifications for an associated interval, such as a frame or a subframe. The foregoing speech classifications may define one or more triggering characteristics that may be present in an interval of an input speech signal. The presence or absence of a certain triggering characteristic in the interval may facilitate the selection of an appropriate encoding scheme for a frame or subframe associated with the interval.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52. The fixed codebook 50 and the adaptive codebook 36 define excitation vectors. Once the LPC analyzer 30 determines the filter parameters of the synthesis filters 42, the encoder 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a sub-codebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder may alter the present excitation vectors in its codebook in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoder 11 may apply different excitation vectors from the adaptive codebook 36 on a frame-by-frame basis or a subframe-by-subframe basis. Similarly, the filter coefficients of one or more synthesis filters 42 may be altered or updated on a frame-by-frame basis. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the perceptual weighting filter 20. As shown in FIG. 1, the first synthesized signal and the weighted input speech signal are inputted into a first summer 46 to obtain an error signal. A minimizer 48 accepts the error signal and minimizes the error signal by adjusting (i.e., searching for and applying) the preferential selection of an excitation vector in the adaptive codebook 36, by adjusting a preferential selection of the first gain adjuster 38 (e.g., first gain codebook), or by adjusting both of the foregoing selections. A preferential selection of the excitation vector and the gain scalar (or gain vector) apply to a subframe or an entire frame of transmission to the decoder 70 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoder 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), which may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by adjusting (i.e., searching for and applying) the preferential selection of an excitation vector in the fixed codebook 50, by adjusting a preferential selection of the second gain adjuster 52 (e.g., second gain codebook), or by adjusting both of the foregoing selections. A preferential selection of the excitation vector and the gain scalar (or gain vector) apply to a subframe or an entire frame. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 1, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the perceptual weighing filter 20 and other applicable filter.

A transmitter 62 or a transceiver is coupled to the multiplexer 60. The transmitter 62 transmits the reference information from the encoder 11 to a receiver 66 via an electromagnetic signal (e.g., radio frequency or microwave signal) of a wireless system as illustrated in FIG. 1. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 66 is coupled to a demultiplexer 68 for demultiplexing the reference information. In turn, the demultiplexer 68 is coupled to a decoder 70 for decoding the reference information into an output speech signal. As shown in FIG. 1, the decoder 70 receives reference information transmitted over the air interface 64 from the encoder 11. The decoder 70 uses the received reference information to create a preferential excitation signal. The reference information facilitates accessing of a duplicate adaptive codebook and a duplicate fixed codebook to those at the encoder 70. One or more excitation generators of the decoder 70 apply the preferential excitation signal to a duplicate synthesis filter. The same values or approximately the same values are used for the filter coefficients at both the encoder 11 and the decoder 70. The output speech signal obtained from the contributions of the duplicate synthesis filter and the duplicate adaptive codebook is a replica or representation of the input speech inputted into the encoder 11. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

Figure 2:
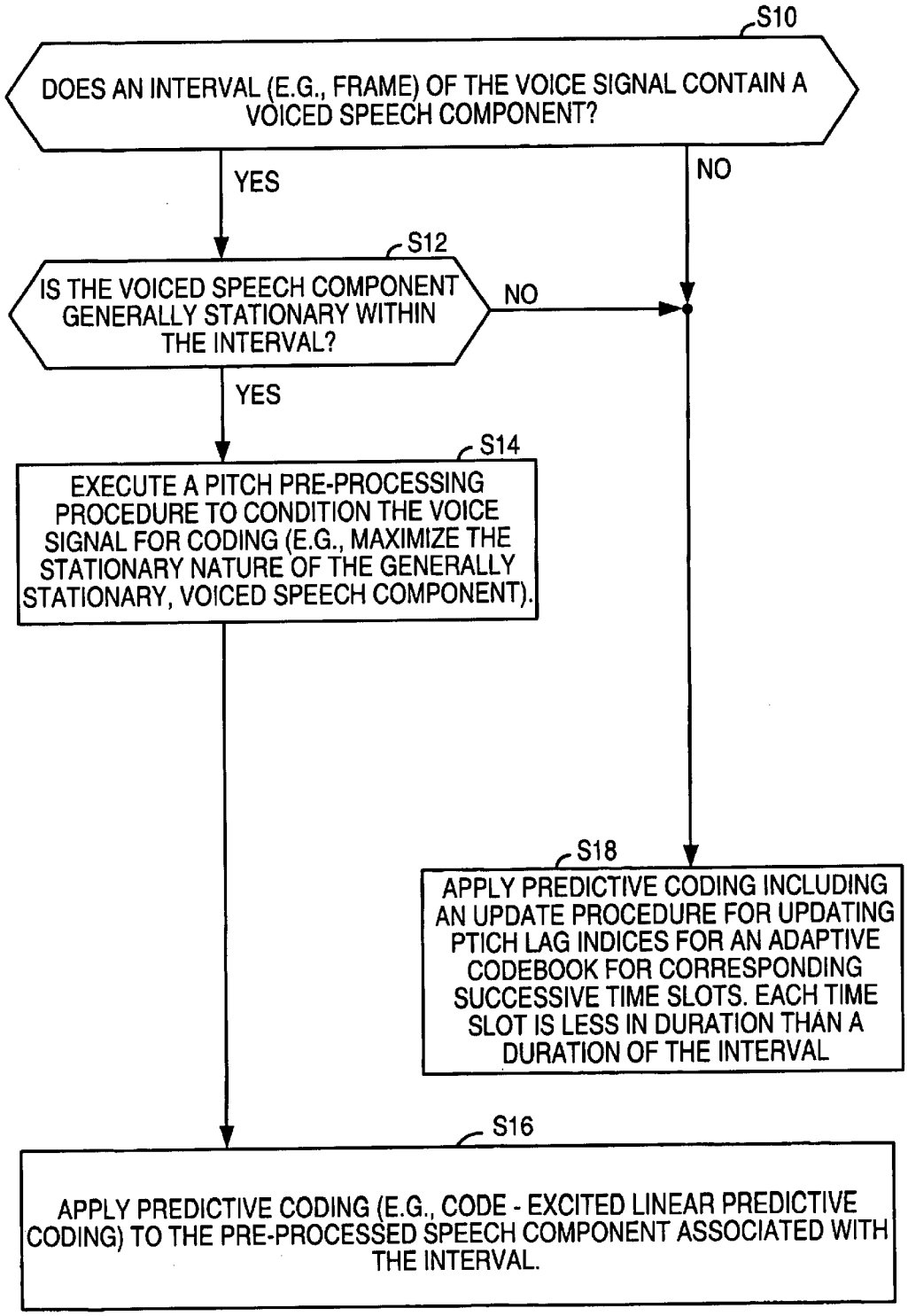
FIG. 2 is a flow chart of one embodiment of a method for encoding a speech signal.

FIG. 2 illustrates a flow chart of a method for encoding an input speech signal in accordance with the invention. The method of FIG. 2 begins in step S10. In general, step S10 and step S12 deal with the detection of a triggering characteristic in an input speech signal. A triggering characteristic may include any characteristic that is handled or classified by the speech characteristic classifier 26, the detector 24, or both. As shown in FIG. 2, the triggering characteristic comprises a generally voiced and generally stationary speech component of the input speech signal in step S10 and S12.

In step S10, a detector 24 or the encoder 11 determines if an interval of the input speech signal contains a generally voiced speech component. A voiced speech component refers to a generally periodic portion or quasiperiodic portion of a speech signal. A quasiperiodic portion may represent a waveform that deviates somewhat from the ideally periodic voiced speech component. An interval of the input speech signal may represent a frame, a group of frames, a portion of a frame, overlapping portions of adjacent frames, or any other time period that is appropriate for evaluating a triggering characteristic of an input speech signal. If the interval contains a generally voiced speech component, the method continues with step S12. If the interval does not contain a generally voiced speech component, the method continues with step S18.

In step S12, the detector 24 or the encoder 11 determines if the voiced speech component is generally stationary or somewhat stationary within the interval. A generally voiced speech component is generally stationary or somewhat stationary if one or more of the following conditions are satisified: (1) the predominate frequency or pitch lag of the voiced speech signal does not vary more than a maximum range (e.g., a predefined percentage) within the frame or interval; (2) the spectral content of the speech signal remains generally constant or does not vary more than a maximum range within the frame or interval; and (3) the level of energy of the speech signal remains generally constant or does not vary more than a maximum range within the frame or the interval. However, in another embodiment, at least two of the foregoing conditions are preferably met before voiced speech component is considered generally stationary. In general, the maximum range or ranges may be determined by perceptual speech encoding tests or characteristics of waveform shapes of the input speech signal that support sufficiently accurate reproduction of the input speech signal. In the context of the pitch lag, the maximum range may be expressed as frequency range with respect to the central or predominate frequency of the voiced speech component or as a time range with respect to the central or predominate pitch lag of the voiced speech component. If the voiced speech component is generally stationary within the interval, the method continues with step S14. If the voiced speech component is generally not stationary within the interval, the method continues with step S18.

In step S14, the pitch pre-processing module 22 executes a pitch pre-processing procedure to condition the input voice signal for coding. Conditioning refers to artificially maximizing (e.g., digital signal processing) the stationary nature of the naturally-occurring, generally stationary voiced speech component. If the naturally-occuring, generally stationary voiced component of the input voice signal differs from an ideal stationary voiced component, the pitch pre-processing is geared to bring the naturally-occurring, generally stationary voiced component closer to the ideal stationary, voiced component. The pitch pre-processing may condition the input signal to bias the signal more toward a stationary voiced state than it would otherwise be to reduce the bandwidth necessary to represent and transmit an encoded speech signal over the air interface. Alternatively, the pitch pre-processing procedure may facilitate using different voice coding schemes that feature different allocations of storage units between a fixed codebook index 74 and an adaptive codebook index 72. With the pitch pre-processing, the different frame types and attendant bit allocations may contribute toward enhancing perceptual speech quality.

The pitch pre-processing procedure includes a pitch tracking scheme that may modify a pitch lag of the input signal within one or more discrete time intervals. A discrete time interval may refer to a frame, a portion of a frame, a sub-frame, a group of sub-frames, a sample, or a group of samples. The pitch tracking procedure attempts to model the pitch lag of the input speech signal as a series of continuous segments of pitch lag versus time from one adjacent frame to another during multiple frames or on a global basis. Accordingly, the pitch pre-processing procedure may reduce local fluctuations within a frame in a manner that is consistent with the global pattern of the pitch track.

The pitch pre-processing may be accomplished in accordance with several alternative techniques. In accordance with a first technique, step S14 may involve the following procedure: An estimated pitch track is estimated for the inputted speech signal. The estimated pitch track represents an estimate of a global pattern of the pitch over a time period that exceeds one frame. The pitch track may be estimated consistent with a lowest cumulative path error for the pitch track, where a portion of the pitch track associated with each frame contributes to the cumulative path error. The path error provides a measure of the difference between the actual pitch track (i.e., measured) and the estimated pitch track. The inputted speech signal is modified to follow or match the estimated pitch track more than it otherwise would.

The inputted speech signal is modeled as a series of segments of pitch lag versus time, where each segment occupies a discrete time interval. If a subject segment that is temporally proximate to other segments has a shorter lag than the temporally proximate segments, the subject segment is shifted in time with respect to the other segments to produce a more uniform pitch consistent with the estimated pitch track. Discontinuities between the shifted segments and the subject segment are avoided by using adjacent segments that overlap in time. In one example, interpolation or averaging may be used to join the edges of adjacent segments in a continuous manner based upon the overlapping region of adjacent segments.

In accordance with a second technique, the pitch preprocessing performs continuous time-warping of perceptually weighted speech signal as the input speech signal. For continuous warping, an input pitch track is derived from at least one past frame and a current frame of the input speech signal or the weighted speech signal. The pitch pre-processing module 22 determines an input pitch track based on multiple frames of the speech signal and alters variations in the pitch lag associated with at least one corresponding sample to track the input pitch track.

The weighted speech signal is modified to be consistent with the input pitch track. The samples that compose the weighted speech signal are modified on a pitch cycle-by-pitch cycle basis. A pitch cycle represents the period of the pitch of the input speech signal. If a prior sample of one pitch cycle falls in temporal proximity to a later sample (e.g., of an adjacent pitch cycle), the duration of the prior and later samples may overlap and be arranged to avoid discontinuities between the reconstructed/modified segments of pitch track. The time warping may introduce a variable delay for samples of the weighted speech signal consistent with a maximum aggregate delay. For example, the maximum aggregate delay may be 20 samples (2.5 ms) of the weighted speech signal.

In step S18, the encoder 11 applies a predictive coding procedure to the inputted speech signal or weighted speech signal that is not generally voiced or not generally stationary, as determined by the detector 24 in steps S10 and S12. For example, the encoder 11 applies a predictive coding procedure that includes an update procedure for updating pitch lag indices for an adaptive codebook 36 for a subframe or another duration less than a frame duration. As used herein, a time slot is less in duration than a duration of a frame. The frequency of update of the adaptive codebook indices of step S18 is greater than the frequency of update that is required for adequately representing generally voiced and generally stationary speech.

After step S14 in step S16, the encoder 11 applies predictive coding (e.g., code-excited linear predictive coding or a variant thereof) to the pre-processed speech component associated with the interval. The predictive coding includes the determination of the appropriate excitation vectors from the adaptive codebook 36 and the fixed codebook 50.

Figure 3:
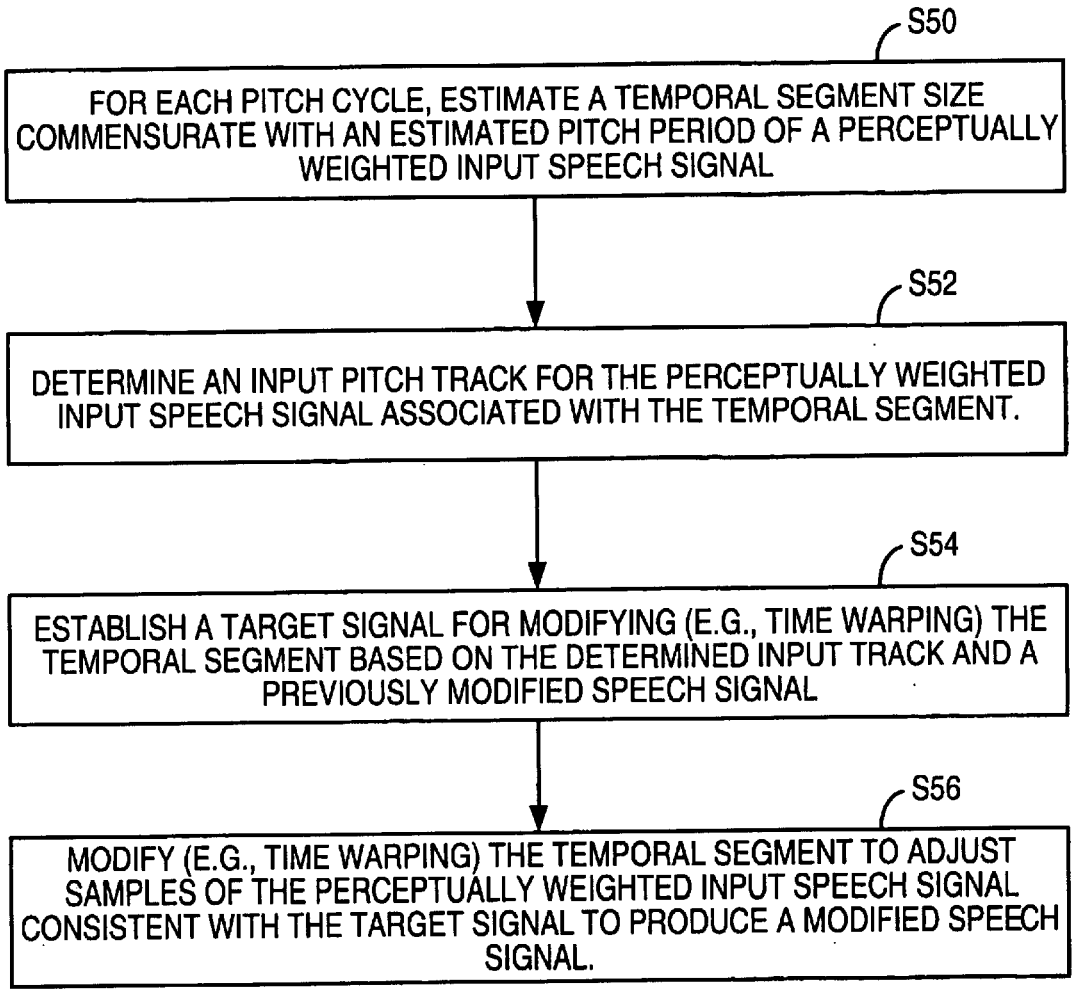
FIG. 3 is a flow chart of one technique for pitch pre-processing in accordance with FIG. 2.

FIG. 3 shows a method for pitch-preprocessing that relates to or further defines step S14 of FIG. 2. The method of FIG. 3 starts with step S50.

In step S50, for each pitch cycle, the pitch pre-processing module 22 estimates a temporal segment size commensurate with an estimated pitch period of a perceptually weighted input speech signal or another input speech signal. The segment sizes of successive segments may track changes in the pitch period.

In step S52, the pitch estimator 32 determines an input pitch track for the perceptually weighted input speech signal associated with the temporal segment. The input pitch track includes an estimate of the pitch lag per frame for a series of successive frames.

In step S54, the pitch pre-processing module 22 establishes a target signal for modifying (e.g., time warping) the weighted input speech signal. In one example, the pitch pre-processing module 22 establishes a target signal for modifying the temporal segment based on the determined input pitch track. In another example, the target signal is based on the input pitch track determined in step S52 and a previously modified speech signal from a previous execution of the method of FIG. 3.

In step S56, the pitch-preprocessing module 22 modifies (e.g., warps) the temporal segment to obtain a modified segment. For a given modified segment, the starting point of the modified segment is fixed in the past and the end point of the modified segment is moved to obtain the best representative fit for the pitch period. The movement of the endpoint stretches or compresses the time of the perceptually weighted signal affiliated with the size of the segment. In one example, the samples at the beginning of the modified segment are hardly shifted and the greatest shift occurs at the end of the modified segment.

The pitch complex (the main pulses) typically represents the most perceptually important part of the pitch cycle. The pitch complex of the pitch cycle is positioned towards the end of the modified segment in order to allow for maximum contribution of the warping on the perceptually most important part.

In one embodiment, a modified segment is obtained from the temporal segment by interpolating samples of the previously modified weighted speech consistent with the pitch track and appropriate time windows (e.g., Hamming-weighted Sinc window). The weighting function emphasizes the pitch complex and de-emphasizes the noise between pitch complexes. The weighting is adapted according to the pitch pre-processing classification, by increasing the emphasis on the pitch complex for segments of higher periodicity. The weighting may vary in accordance with the pitch pre-processing classification, by increasing the emphasis on the pitch complex for segments of higher periodicity.

The modified segment is mapped to the samples of the perceptually weighted input speech signal to adjust the perceptually weighted input speech signal consistent with the target signal to produce a modified speech signal. The mapping definition includes a warping function and a time shift function of samples of the perceptually weighted input speech signal.

In accordance with one embodiment of the method of FIG. 3, the pitch estimator 32, the pre-processing module 22, the selector 34, the speech characteristic classifier 26, and the voice activity detector 28 cooperate to support pitch pre-processing the weighted speech signal. The speech characteristic classifier 26 may obtain a pitch pre-processing controlling parameter that is used to control one or more steps of the pitch pre-processing method of FIG. 3.

A pitch pre-processing controlling parameter may be classified as a member of a corresponding category. Several categories of controlling parameters are possible. A first category is used to reset the pitch pre-processing to prevent the accumulated delay introduced during pitch pre-processing from exceeding a maximum aggregate delay. The second category, the third category, and the fourth category indicate voice strength or amplitude. The voice strengths of the second category through the fourth category are different from each other.

The first category may permit or suspend the execution of step S56. If the first category or another classification of the frame indicates that the frame is predominantly background noise or unvoiced speech with low pitch correlation, the pitch pre-processing module 22 resets the pitch pre-processing procedure to prevent the accumulated delay from exceeding the maximum delay. Accordingly, the subject frame is not changed in step S56 and the accumulated delay of the pitch preprocessing is reset to zero, so that the next frame can be changed, where appropriate. If the first category or another classification of the frame is predominately pulse-like unvoiced speech, the accumulated delay in step S56 is maintained without any warping of the signal, and the output signal is a simple time shift consistent with the accumulated delay of the input signal.

For the remaining classifications of pitch pre-processing controlling parameters, the pitch preprocessing algorithm is executed to warp the speech signal in step S56. The remaining pitch pre-processing controlling parameters may control the degree of warping employed in step S56.

After modifying the speech in step S56, the pitch estimator 32 may estimate the pitch gain and the pitch correlation with respect to the modified speech signal. The pitch gain and the pitch correlation are determined on a pitch cycle basis. The pitch gain is estimated to minimize the mean-squared error between the target signal and the final modified signal.

Figure 4:
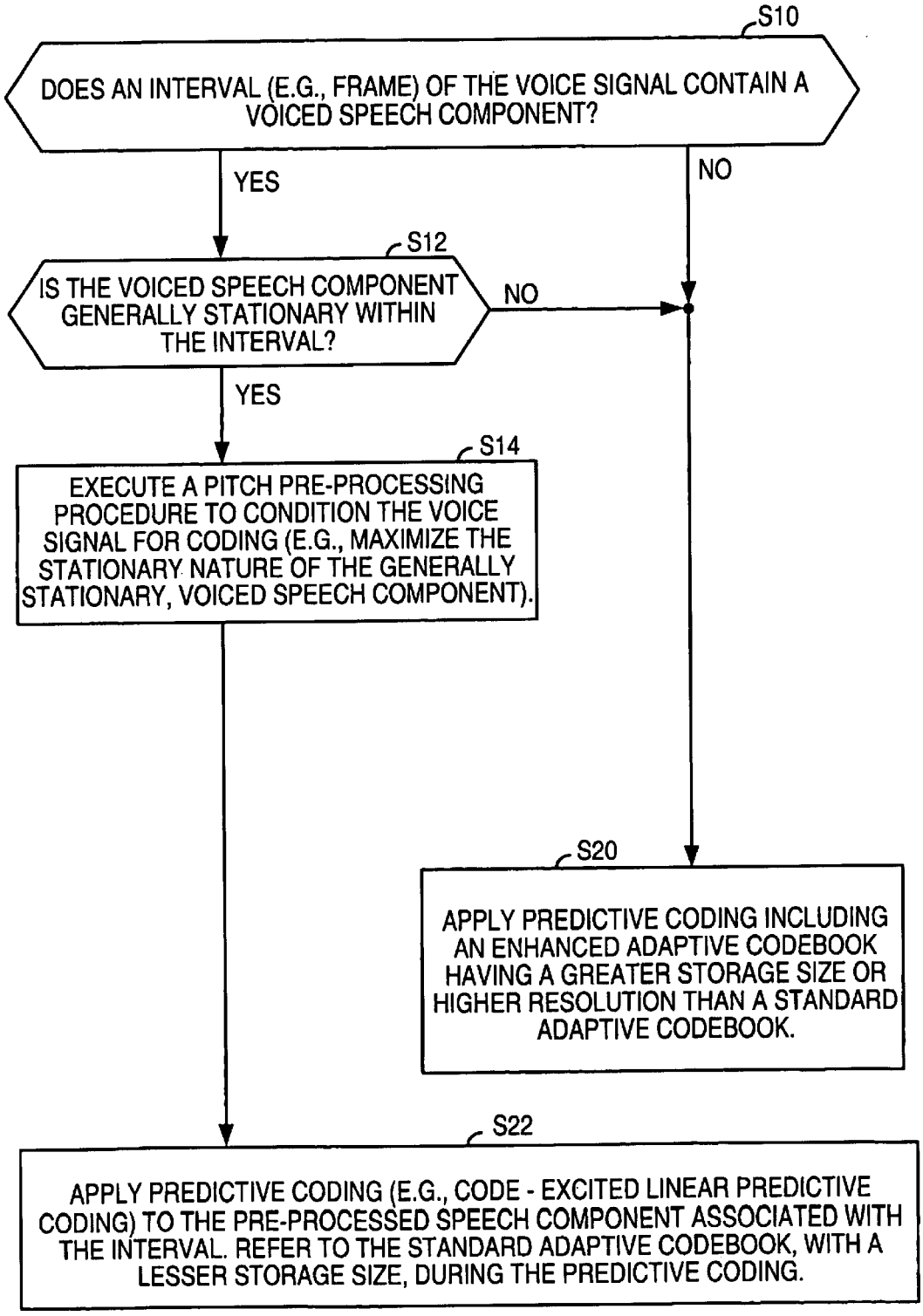
FIG. 4 is a flow chart of another method for encoding.

FIG. 4 includes another method for coding a speech signal in accordance with the invention. The method of FIG. 4 is similar to the method of FIG. 2 except the method of FIG. 4 references an enhanced adaptive codebook in step S20 rather than a standard adaptive codebook. An enhanced adaptive codebook has a greater number of quantization intervals, which correspond to a greater number of possible excitation vectors, than the standard adaptive codebook. The adaptive codebook 36 of FIG. 1 may be considered an enhanced adaptive codebook or a standard adaptive codebook, as the context may require. Like reference numbers in FIG. 2 and FIG. 4 indicate like elements.

Steps S10, S12, and S14 have been described in conjunction with FIG. 2. Starting with step S20, after step S10 or step S12, the encoder applies a predictive coding scheme. The predictive coding scheme of step S20 includes an enhanced adaptive codebook that has a greater storage size or a higher resolution (i.e., a lower quantization error) than a standard adaptive codebook. Accordingly, the method of FIG. 4 promotes the accurate reproduction of the input speech with a greater selection of excitation vectors from the enhanced adaptive codebook.

In step S22 after step S14, the encoder 11 applies a predictive coding scheme to the pre-processed speech component associated with the interval. The coding uses a standard adaptive codebook with a lesser storage size.

Figure 5:
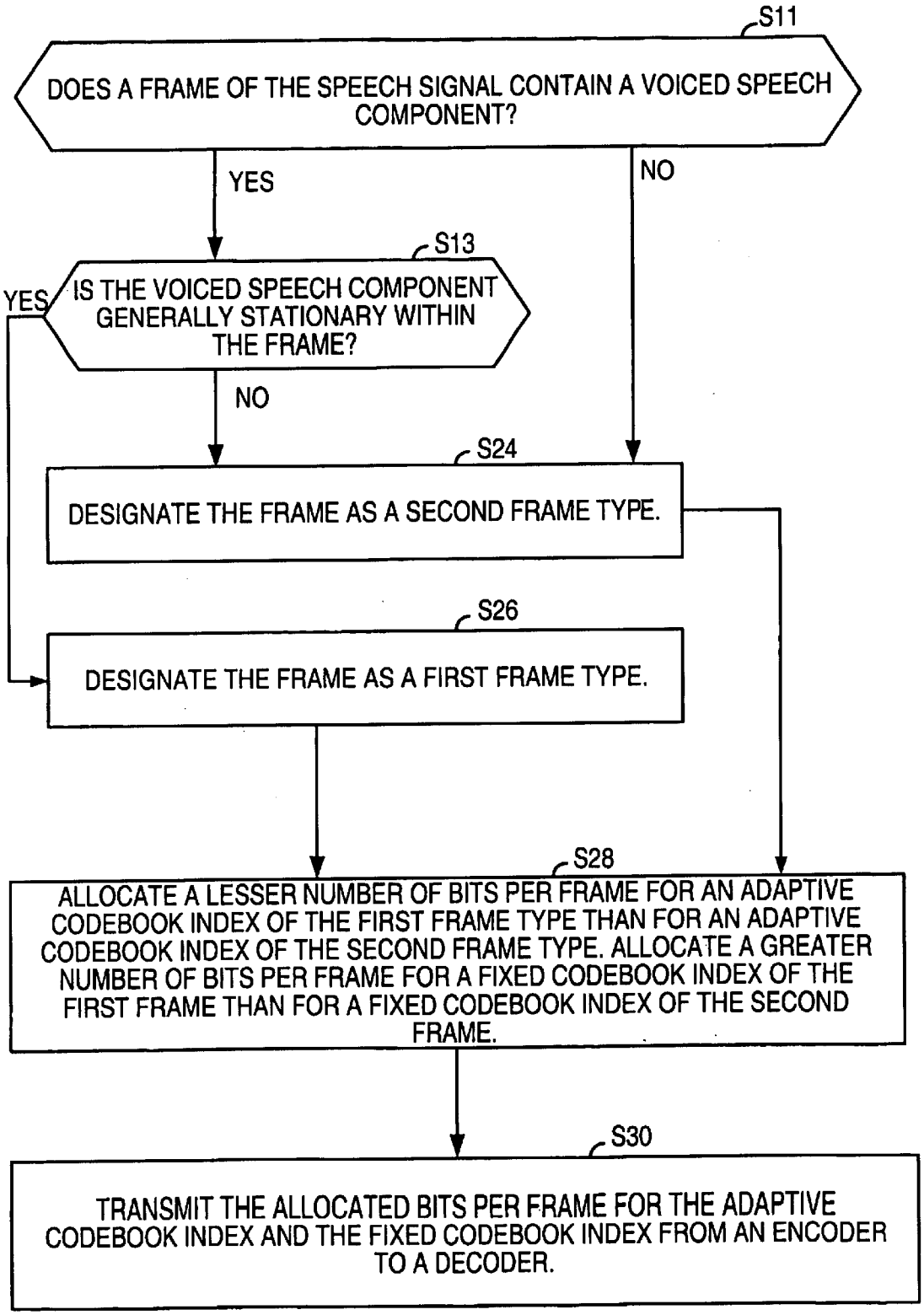
FIG. 5 is a flow chart of a bit allocation procedure.

FIG. 5 shows a method of coding a speech signal in accordance with the invention. The method starts with step S11.

In general, step S11 and step S13 deal with the detection of a triggering characteristic in an input speech signal. A triggering characteristic may include any characteristic that is handled or classified by the speech characteristic classifier 26, the detector 24, or both. As shown in FIG. 5, the triggering characteristic comprises a generally voiced and generally stationary speech component of the speech signal in step S11 and S13.

In step S11, the detector 24 or encoder 11 determines if a frame of the speech signal contains a generally voiced speech component. A generally voiced speech component refers to a periodic portion or quasiperiodic portion of a speech signal. If the frame of an input speech signal contains a generally voiced speech, the method continues with step S13. However, if the frame of the speech signal does not contain the voiced speech component, the method continues with step S24.

In step S13, the detector 24 or encoder 11 determines if the voiced speech component is generally stationary within the frame. A voiced speech component is generally stationary if the predominate frequency or pitch lag of the voiced speech signal does not vary more than a maximum range (e.g., a predefined percentage) within the frame or interval. The maximum range may be expressed as frequency range with respect to the central or predominate frequency of the voiced speech component or as a time range with respect to the central or predominate pitch lag of the voiced speech component. The maximum range may be determined by perceptual speech encoding tests or waveform shapes of the input speech signal. If the voiced speech component is stationary within the frame, the method continues with step S26. Otherwise, if the voiced speech component is not generally stationary within the frame, the method continues with step S24.

In step S24, the encoder 11 designates the frame as a second frame type having a second data structure. An illustrative example of the second data structure of the second frame type is shown in FIG. 6, which will be described in greater detail later.

In an alternate step for step S24, the encoder 11 designates the frame as a second frame type if a higher encoding rate (e.g., full-rate encoding) is applicable and the encoder 11 designates the frame as a fourth frame type if a lesser encoding rate (e.g., half-rate encoding) is applicable. Applicability of the encoding rate may depend upon a target quality mode for the reproduction of a speech signal on a wireless communications system. An illustrative example of the fourth frame type is shown in FIG. 7, which will be described in greater detail later.

In step S26, the encoder designates the frame as a first frame type having a first data structure. An illustrative example of the first frame type is shown in FIG. 6, which will be described in greater detail later.

In an alternate step for step S26, the encoder 11 designates the frame as a first frame type if a higher encoding rate (e.g., full-rate encoding) is applicable and the encoder 11 designates the frame as a third frame type if a lesser encoding rate (e.g., half-rate encoding) is applicable. Applicability of the encoding rate may depend upon a target quality mode for the reproduction of a speech signal on a wireless communications system. An illustrative example of the third frame type is shown in FIG. 7, which will be described in greater detail later.

In step S28, an encoder 11 allocates a lesser number of storage units (e.g., bits) per frame for an adaptive codebook index 72 of the first frame type than for an adaptive codebook index 72 of the second frame type. Further, the encoder allocates a greater number of storage units (e.g., bits) per frame for a fixed codebook index 74 of the first frame type than for a fixed codebook index 74 of the second frame type. The foregoing allocation of storage units may enhance long-term predictive coding for a second frame type and reduce quantization error associated with the fixed codebook for a first frame type. The second allocation of storage units per frame of the second frame type allocates a greater number of storage units to the adaptive codebook index than the first allocation of storage units of the first frame type to facilitate long-term predictive coding on a subframe-by-subframe basis, rather than a frame-by-frame basis. In other words, the second encoding scheme has a pitch track with a greater number of storage units (e.g., bits) per frame than the first encoding scheme to represent the pitch track. The first allocation of storage units per frame allocates a greater number of storage units for the fixed codebook index than the second allocation does to reduce a quantization error associated with the fixed codebook index.

The differences in the allocation of storage units per frame between the first frame type and the second frame type may be defined in accordance with an allocation ratio. As used herein, the allocation ratio (R) equals the number of storage units per frame for the adaptive codebook index (A) divided by the number of storage units per frame for the adaptive codebook index (A) plus the number of storage units per frame for the fixed codebook index (F). The allocation ratio is mathematically expressed as $R=A/(A+F)$. Accordingly, the allocation ratio of the second frame type is greater than the allocation ratio of the first frame type to foster enhanced perceptual quality of the reproduced speech.

The second frame type has a different balance between the adaptive codebook index and the fixed codebook index than the first frame type has to maximize the perceived quality of the reproduced speech signal. Because the first frame type carries generally stationary voiced data, a lesser number of storage units (e.g., bits) of adaptive codebook index provide a truthful reproduction of the original speech signal consistent with a target perceptual standard. In contrast, a greater number of storage units is required to adequately express the remnant speech characteristics of the second frame type to comply with a target perceptual standard. The lesser number of storage units are required for the adaptive codebook index of the second frame because the long-term information of the speech signal is generally uniformly periodic. Thus, for the first frame type, a past sample of the speech signal provides a reliable basis for a future estimate of the speech signal. The difference between the total number of storage units and the lesser number of storage units provides a bit or word surplus that is used to enhance the performance of the fixed codebook 50 for the first frame type or reduce the bandwidth used for the air interface. The fixed codebook can enhance the quality of speech by improving the accuracy of modeling noise-like speech components and transients in the speech signal.

After step S28 in step S30, the encoder 11 transmits the allocated storage units (e.g., bits) per frame for the adaptive codebook index 72 and the fixed codebook index 74 from an encoder 11 to a decoder 70 over an air interface 64 of a wireless communications system. The encoder 11 may include a rate-determination module for determining a desired transmission rate of the adaptive codebook index 72 and the fixed codebook index 74 over the air interface 64. For example, the rate determination module may receive an input from the speech classifier 26 of the speech classifications for each corresponding time interval, a speech quality mode selection for a particular subscriber station of the wireless communication system, and a classification output from a pitch pre-processing module 22.

FIG. 6 and FIG. 7 illustrate a higher-rate coding scheme (e.g., full-rate ) and a lower-rate coding scheme (e.g., half-rate), respectively. As shown the higher-rate coding scheme provides a higher transmission rate per frame over the air interface 64. The higher-rate coding scheme supports a first frame type and a second frame type. The lower-rate coding scheme supports a third frame type and a fourth frame type. The first frame, the second frame, the third frame, and the fourth frame represent data structures that are transmitted over an air interface 64 of a wireless system from the encoder 11 to the decoder 60. A type identifier 71 is a symbol or bit representation that distinguishes on frame type from another. For example, in FIG. 6 the type identifier is used to distinguish the first frame type from the second frame type.

The data structures provide a format for representing the reference data that represents a speech signal. The reference data may include the filter coefficient indicators 76 (e.g., LSF's), the adaptive codebook indices 72, the fixed codebook indices 74, the adaptive codebook gain indices 80, and the fixed codebook gain indices 78, or other reference data, as previously described herein. The foregoing reference data was previously described in conjunction with FIG. 1.

The first frame type represents generally stationary voiced speech. Generally stationary voiced speech is characterized by a generally periodic waveform or quasiperiodic waveform of a long-term component of the speech signal. The second frame type is used to encode speech other than generally stationary voiced speech. As used herein, speech other than stationary voiced speech is referred to a remnant speech. Remnant speech includes noise components of speech, plosives, onset transients, unvoiced speech, among other classifications of speech characteristics. The first frame type and the second frame type preferably include an equivalent number of subframes (e.g., 4 subframes) within a frame. Each of the first frame and the second frame may be approximately 20 milliseconds long, although other different frame durations may be used to practice the invention. The first frame and the second frame each contain an approximately equivalent total number of storage units (e.g., 170 bits).

The column labeled first encoding scheme 97 defines the bit allocation and data structure of the first frame type. The column labeled second encoding scheme 99 defines the bit allocation and data structure of the second frame type. The allocation of the storage units of the first frame differs from the allocation of storage units in the second frame with respect to the balance of storage units allocated to the fixed codebook index 74 and the adaptive codebook index 72. In particular, the second frame type allots more bits to the adaptive codebook index 72 than the first frame type does. Conversely, the second frame type allots less bits for the fixed codebook index 74 than the first frame type. In one example, the second frame type allocates 26 bits per frame to the adaptive codebook index 72 and 88 bits per frame to the fixed codebook index 74.

Meanwhile, the first frame type allocates 8 bits per frame to the adaptive codebook index 72 and only 120 bits per frame to the fixed codebook index 74.

Lag values provide references to the entries of excitation vectors within the adaptive codebook 36. The second frame type is geared toward transmitting a greater number of lag values per unit time (e.g., frame) than the first frame type. In one embodiment, the second frame type transmits lag values on a subframe-by-subframe basis, whereas the first frame type transmits lag values on a frame by frame basis. For the second frame type, the adaptive codebook 36 indices or data may be transmitted from the encoder 11 and the decoder 70 in accordance with a differential encoding scheme as follows. A first lag value is transmitted as an eight bit code word. A second lag value is transmitted as a five bit codeword with a value that represents a difference between the first lag value and absolute second lag value. A third lag value is transmitted as an eight bit codeword that represents an absolute value of lag. A fourth lag value is transmitted as a five bit codeword that represents a difference between the third lag value an absolute fourth lag value. Accordingly, the resolution of the first lag value through the fourth lag value is substantially uniform despite the fluctuations in the raw numbers of transmitted bits, because of the advantages of differential encoding.

For the lower-rate coding scheme, which is shown in FIG. 7, the encoder 11 supports a third encoding scheme 103 described in the middle column and a fourth encoding scheme 101 described in the rightmost column. The third encoding scheme 103 is associated with the fourth frame type. The fourth encoding scheme 101 is associated with the fourth frame type.

The third frame type is a variant of the second frame type, as shown in the middle column of FIG. 7. The fourth frame type is configured for a lesser transmission rate over the air interface 64 than the second frame type. Similarly, the third frame type is a variant of the first frame type, as shown in the rightmost column of FIG. 7. Accordingly, in any embodiment disclosed in the specification, the third encoding scheme 103 may be substituted for the first encoding scheme 99 where a lower-rate coding technique or lower perceptual quality suffices. Likewise, in any embodiment disclosed in the specification, the fourth encoding scheme 101 may be substituted for the second encoding scheme 97 where a lower rate coding technique or lower perceptual quality suffices.

The third frame type is configured for a lesser transmission rate over the air interface 64 than the second frame. The total number of bits per frame for the lower-rate coding schemes of FIG. 6 is less than the total number of bits per frame for the higher-rate coding scheme of FIG. 7 to facilitate the lower transmission rate. For example, the total number of bits for the higher-rate coding scheme may approximately equal 170 bits, while the number of bits for the lower-rate coding scheme may approximately equal 80 bits. The third frame type preferably includes three subframes per frame. The fourth frame type preferably includes two subframes per frame.

The allocation of bits between the third frame type and the fourth frame type differs in a comparable manner to the allocated difference of storage units within the first frame type and the second frame type. The fourth frame type has a greater number of storage units for adaptive codebook index 72 per frame than the third frame type does. For example, the fourth frame type allocates 14 bits per frame for the adaptive codebook index 72 and the third frame type allocates 7 bits per frame. The difference between the total bits per frame and the adaptive codebook 36 bits per frame for the third frame type represents a surplus. The surplus may be used to improve resolution of the fixed codebook 50 for the third frame type with respect to the fourth frame type. In one example, the fourth frame type has an adaptive codebook 36 resolution of 30 bits per frame and the third frame type has an adaptive codebook 36 resolution of 39 bits per frame.

In practice, the encoder may use one or more additional coding schemes other than the higher-rate coding scheme and the lower-rate coding scheme to communicate a speech signal from an encoder site to a decoder site over an air interface 64. For example, an additional coding schemes may include a quarter-rate coding scheme and an eighth-rate coding scheme. In one embodiment, the additional coding schemes do not use the adaptive codebook 36 data or the fixed codebook 50 data. Instead, additional coding schemes merely transmit the filter coefficient data and energy data from an encoder to a decoder.

The selection of the second frame type versus the first frame type and the selection of the fourth frame type versus the third frame type hinges on the detector 24, the speech characteristic classifier 26, or both. If the detector 24 determines that the speech is generally stationary voiced during an interval, the first frame type and the third frame type are available for coding. In practice, the first frame type and the third frame type may be selected for coding based on the quality mode selection and the contents of the speech signal. The quality mode may represent a speech quality level that is determined by a service provider of a wireless service.

In accordance with one aspect the invention, a speech encoding system for encoding an input speech signal allocates storage units of a frame between an adaptive codebook index and a fixed codebook index depending upon the detection of a triggering characteristic of the input speech signal. The different allocations of storage units facilitate enhanced perceptual quality of reproduced speech, while conserving the available bandwidth of an air interface of a wireless system.

Further technical details that describe the present invention are set forth in co-pending U.S. application Ser. No. 09/154,660, filed on Sep. 18, 1998, entitled SPEECH ENCODER ADAPTIVELY APPLYING PITCH PREPROCESSING WITH CONTINUOUS WARPING, which is hereby incorporated by reference herein.

While various embodiments of the invention have been described, it will be apparent to those of ordinary skill in the art that many more embodiments and implementations are possible that are within the scope of the invention. Accordingly, the invention is not to be restricted except in light of the attached claims and their equivalents.

What is claimed is:

1. A speech encoding system comprising:

a detector for detecting whether an input speech signal generally has a triggering characteristic during an interval;

an encoder supporting at least one of a first encoding scheme and a second encoding scheme applicable to the speech signal for a frame associated with the interval, the first encoding scheme having a preprocessing procedure for processing the inputted speech signal to form a revised speech signal biased toward a generally ideal voiced and stationary characteristic; and a selector for selecting one of the first encoding scheme and the second encoding scheme based upon the detection or absence of the triggering characteristic in the interval of the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type is different from the first frame type;

wherein said first frame type allocates 25 bits for filter coefficient indicators, 1 bit for a type indicator, 8 bits for an adaptive codebook index, 120 bits for a fixed codebook index, 6 bits for an adaptive codebook gain, and 10 bits for a fixed codebook gain.

2. The speech encoding system according to claim 1 where the triggering characteristic comprises a generally voiced and generally stationary speech component of the input speech signal.

3. The speech encoding system according to claim 1 where the selector selects the first encoding scheme if the detector determines that the speech signal is generally stationary and generally periodic during the frame.

4. The speech encoding system according to claim 1 where the selector selects the second encoding scheme if the detector determines that the input speech signal is generally nonstationary during the frame.

5. The speech encoding system according to claim 1 further comprising:

a perceptual weighting filter for filtering the input speech signal;

a pitch-preprocessing module having an input coupled to an output of the perceptual weighting filter, the pitch pre-processing module determining a target signal for time warping the weighted speech signal.

6. The speech encoding system according to claim 1 further comprising a pitch pre-processing module for determining an input pitch track based on multiple frames of the input speech signal and altering variations in the pitch lag associated with samples to track the input pitch track.

7. The speech encoding system according to claim 1 where the first encoding scheme has a first allocation of storage units per frame between a fixed codebook index and an adaptive codebook index, the second scheme having a second allocation of storage units per the frame between the fixed codebook index and the adaptive codebook index, where the first allocation differs from the second allocation.

8. The speech encoding system according to claim 7 where the second allocation of storage units per frame allocates a greater number of storage units to the adaptive codebook index than the first allocation of storage units to facilitate long-term predictive coding on a subframe-by-subframe basis.

9. The speech encoding system according to claim 7 where the first allocation of storage units per frame allocates a greater number of storage units for the fixed codebook index than the second allocation does to reduce a quantization error associated with the fixed codebook index.

10. The speech encoding system according to claim 7 where the second encoding scheme has a higher allocation ratio than the first encoding scheme, the allocation ratio defined by a number of storage units allocated to the adaptive codebook index divided by the number of storage units allocated to the adaptive codebook index plus the fixed codebook index.

11. The speech encoding system according to claim 7 where, the selected rate for coding the input speech signal is full-rate, where the first encoding scheme uses the first frame type for coding the input speech signal at the full-rate and the second encoding scheme uses the second frame type for coding the input speech signal at the full-rate.

12. The speech encoding system according to claim 7 where, if the selected rate is a higher-rate coding, the first encoding scheme uses the first frame type and the second encoding scheme uses the second frame type, and if the selected rate is a lower-rate coding the first encoding scheme uses a third frame type and the second encoding scheme uses a fourth frame type.

13. A speech encoding system comprising:

a detector for detecting whether an input speech signal generally has a generally voiced and generally stationary characteristic during an interval;

an encoder supporting at least one of a first encoding scheme and a second encoding scheme applicable to the input speech signal for a frame associated with the interval, the second encoding scheme having long-term prediction procedure for processing the input speech signal on a sub-frame-by-subframe basis;

a selector for selecting one of the first encoding scheme and the second encoding scheme based upon said detection or absence of the generally voiced and generally stationary characteristic in the interval of the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type;

wherein said first frame type allocates 25 bits for filter coefficient indicators, 1 bit for a type indicator, 8 bits for an adaptive codebook index, 120 bits for a fixed codebook index, 6 bits for an adaptive codebook gain, and 10 bits for a fixed codebook gain.

14. The speech encoding system according to claim 13 where the selector selects the second encoding scheme if the detector determines that the input speech signal is not generally periodic during the frame.

15. The speech encoding system according to claim 13 where the selector selects the second encoding scheme if the detector determines that the input speech signal is generally nonstationary during the frame.

16. The speech encoding system according to claim 13 where the second encoding scheme has a pitch track with a greater number of bits per frame than the first encoding scheme to represent the pitch track.

17. The speech encoding system according to claim 13 where the first encoding scheme has a first allocation of storage units per the frame between a fixed codebook index and an adaptive codebook index, where the second encoding scheme has a second allocation of storage units per the frame between the fixed codebook index and the adaptive codebook index, where the second allocation differs from the first allocation, and where the second allocation of storage units per frame allocates a greater number of storage units to the adaptive codebook index than the first allocation of storage units to facilitate long-term predictive coding on a subframe-by-subframe basis.

18. The speech encoding system according to claim 13 where the first encoding scheme has a first allocation of storage units per the frame between a fixed codebook index and an adaptive codebook index, where the second encoding scheme has a second allocation of storage units per the frame between the fixed codebook index and the adaptive codebook index, where the second allocation differs from the first allocation, and where the first allocation of storage units per frame allocates a greater number of storage units for the fixed codebook index than the second allocation does to reduce a quantization error associated with the fixed codebook index.

19. The speech encoding system according to claim 13 where the first encoding scheme has a first allocation of storage units per the frame between a fixed codebook index and an adaptive codebook index, where the second encoding scheme has a second allocation of storage units per the frame between the fixed codebook index and the adaptive codebook index, where the second allocation differs from the first allocation, and where the second encoding scheme has a higher allocation ratio than the first encoding scheme, the allocation ratio defined by a number of storage units allocated to the adaptive codebook index divided by the number of storage units allocated to the adaptive codebook index plus the fixed codebook index.

20. The speech encoding system according to claim 13 where, the selected rate for coding the input speech signal is full-rate, where the first encoding scheme uses the first frame type for coding the speech signal at the full-rate and the second encoding scheme uses the second frame type for coding the speech signal at the full-rate.

21. The speech encoding system according to claim 13 where, if the selected rate is a higher-rate coding, the first encoding scheme uses the first frame type and the second encoding scheme uses the second frame type, and if the selected rate is a lower-rate coding the first encoding scheme uses a third frame type and the second encoding scheme uses a fourth frame type.

22. The speech encoding system of claim 13, wherein said second frame type allocates 27 for said filter coefficient indicators, 1 for said type indicator, 26 bits for said adaptive codebook index 88 for said fixed codebook index, and 28 bits for said adaptive codebook gain and said fixed codebook gain.

23. A speech encoding method comprising the steps of:

detecting whether an input speech signal has a triggering characteristic during an interval;

selecting one of a first encoding scheme and a second encoding scheme, for application to the input speech signal for a frame associated with the interval, based upon said detection of the triggering characteristic; and processing the inputted speech signal in accordance with the first encoding scheme to form a revised input speech signal biased toward a generally ideal voiced and stationary characteristic if the triggering characteristic is detected in the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type;

wherein said first frame type allocates 25 bits for filter coefficient indicators, 1 bit for a type indicator, 8 bits for said an adaptive codebook index, 120 bits for a fixed codebook index, 6 bits for an adaptive codebook gain, and 10 bits for a fixed codebook gain.

24. The method according to claim 23 where the detecting step comprises detecting whether the input speech signal generally has a generally voiced and generally stationary component as the triggering characteristic during the interval.

25. The method according to claim 23 further comprising the step of supporting the first encoding scheme having a first allocation of storage units per the frame between a fixed codebook index and an adaptive codebook index, the second encoding scheme having a second allocation of storage units per the frame between the fixed codebook index and the adaptive codebook index, where the second allocation differs from the first allocation.

26. The method according to claim 23 further comprising the step of processing the inputt speech signal on a subframe-by-subframe basis in accordance with a long-term prediction procedure of the second encoding scheme if the triggering characteristic is not detected during the interval.

27. The method according to claim 25 where the second allocation of storage units per frame allocates a greater number of storage units to the adaptive codebook index than the first allocation of storage units to facilitate long-term predictive coding on a subframe-by-subframe basis.

28. The method according to claim 25 where the first allocation of storage units per frame allocates a greater number of storage units for the fixed codebook index than the second allocation does to reduce a quantization error associated with the fixed codebook index.

29. The method according to claim 25 where the second encoding scheme has a higher allocation ratio than the first encoding scheme, the allocation ratio defined by a number of storage units allocated to the adaptive codebook index divided by the number of storage units allocated to the adaptive codebook index plus the fixed codebook index.

30. The method according to claim 23 where, the selected rate for coding the speech signal is full-rate, where the first encoding scheme uses the first frame type for coding the speech signal at the full-rate and the second encoding scheme uses the second frame type for coding the speech signal at the full-rate.

31. The method according to claim 23 where, if the selected rate is a higher-rate coding, the first encoding scheme uses the first frame type and the second encoding scheme uses the second frame type, and if the selected rate is a lower-rate coding the first encoding scheme uses a third frame type and the second encoding scheme uses a fourth frame type.

32. The speech encoding method of claim 23, wherein said second frame type allocates 27 bits for said filter coefficient indicators, 1 said type indicator, 26 bits for adaptive codebook index, 88 bits for said codebook index, and 28 bits for said adaptive codebook gain said fixed codebook gain.

33. A speech encoding method comprising:

receiving a speech frame for encoding;

classifying said speech frame as a voiced speech frame if said speech frame includes a voiced speech component;

designating said voiced speech frame as a stationary voiced speech frame if said voiced speech frame is generally stationary, otherwise, designating said voiced speech frame as a non- stationary voiced speech frame; and allocating a lesser number of bits for an adaptive codebook index of said stationary voiced speech frame than for an adaptive codebook index of said non-stationary voice speech frame;

allocating a greater number of bits for a fixed codebook index of said stationary voiced speech frame than for a fixed codebook index of said non-stationary voiced speech frame;

determining whether an encoding rate for encoding said speech frame is a high encoding rate or a low encoding rate;

using a first frame type to encode said stationary voiced speech frame if said encoding rate is said high encoding rate;

using a third frame type to encode said stationary voiced speech frame if said encoding rate is said low encoding rate;

wherein said first frame type allocates 25 bits for filter coefficient indicators, 1 bit for a type indicator, 8 bits for said adaptive codebook index, 120 bits for said fixed codebook index, 6 bits for an adaptive codebook gain, and 10 bits for a fixed codebook gain.

34. The speech encoding method of claim 33 further comprising: transmitting said bits to a decoding system.

35. The speech encoding method of claim 33 where said third frame type allocates 21 bits said for filter coefficient indicators, 1 bit for said type indicator, 7 bits for said adaptive codebook index, 39 bits for said fixed codebook index, 4 bits for said adaptive codebook gain, and 8 bits for said fixed codebook gain.

36. A speech encoding system comprising:

a receiver configured to receive a speech frame: for encoding;

a classifier configured to classify said speech frame as a voiced speech frame if said speech frame includes a voiced speech component, said classifier further configured to designate said voiced speech frame as a stationary voiced speech frame if said voiced speech frame is generally stationary, otherwise, said classifier designates said voiced speech frame as a non- stationary voiced speech frame; wherein said encoder is further configured to allocate a greater number of bits for a fixed codebook index of said stationary voiced speech frame than for a fixed codebook index of said non-stationary voiced speech frame;

wherein said encoder is further configured to: determine whether an encoding rate for encoding said speech frame is a high encoding rate or a low encoding rate, use a first frame type to encode said stationary voiced speech frame if said encoding rate is said high encoding rate, and use a third frame type to encode said stationary voiced speech frame if said encoding rate is said low encoding rate;

wherein said first frame type allocates 25 bits for filter coefficient indicators, 1 bit for a type indicator, 8 bits for said adaptive codebood index, 120 bits for said fixed codebook indes, 6 bits for an adaptive codebook gain, and 10 bits for a fixed codebook gain.

37. The speech encoding system of claim 36 further comprising: a transmitter configured to transmit said bits to a decoding system.

38. The speech encoding system of claim 36 where said third frame type allocates 21 bits for filter coefficient indicators, 1 bit for said type indicator, 7 bits for said adaptive codebook index, 39 bits for said fixed codebook index, 4 bits for said adaptive codebook gain, and 8 bits for said fixed codebook gain.

39. A speech encoding system comprising:

a detector for detecting whether an input speech signal generally has a triggering characteristic during an interval;

an encoder supporting at least one of a first encoding scheme and a second encoding scheme applicable to the speech signal for a frame associated with the interval, the first encoding scheme having a preprocessing procedure for processing the input speech signal to form a revised speech signal biased toward a generally ideal voiced and stationary characteristic; and a selector for selecting one of the first encoding scheme and the second encoding scheme based upon the detection or absence of the triggering characteristic in the interval of the input speech signal;

wherein the first encoding scheme uses a first frame type for coding the speech signal at a selected rate and the second encoding scheme uses a second frame type for coding the speech signal at the same selected rate, wherein the second frame type is different from the first frame type;

wherein said first frame type allocates 27 bits for filter coefficient indicators, 1 bit for a type indicator, 26 bits for an adaptive codebook index, 88 bits for a fixed codebook index, and 28 bits for an adaptive codebook gain and a fixed codebook gain.

40. A speech encoding system comprising:

a detector for detecting whether an input speech signal generally has a triggering characteristic during an interval;

an encoder supporting at least one of a first encoding scheme and a second encoding scheme applicable to the speech signal for a frame associated with the interval, the first encoding scheme having a pre-processing procedure for processing the inputted speech signal to form a revised speech signal biased toward a generally ideal voiced and stationary characteristic; and a selector for selecting one of the first encoding scheme and the second encoding scheme based upon the detection or absence of the triggering characteristic in the interval of the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type;

wherein said first frame type allocates 21 bits for filter coefficient indicators, 1 bit for a type indicator, 7 bits for an adaptive codebook index, 39 bits for a fixed codebook index, 4 bits for an adaptive codebook gain, and 8 bits for a fixed codebook gain.

41. The speech encoding system of claim 40, wherein said second frame type allocates 21 bits for said filter coefficient indicators, 1 bit for said type indicator, 14 bits for said adaptive codebook index, 30 bits for said fixed codebook index, 14 bits for said adaptive codebook gain and said fixed codebook gain.

42. A speech encoding system comprising:

a detector for detecting whether an input speech signal generally has a triggering characteristic during an interval;

an encoder supporting at least one of a first encoding scheme and a second encoding scheme applicable to the input speech signal for a frame associated with the interval, the first encoding scheme having a pre-processing procedure for processing the input speech signal to form a revised speech signal biased toward a generally ideal voiced and stationary characteristic; and a selector for selecting one of the first encoding scheme and the second encoding scheme based upon the detection or absence of the triggering characteristic in the interval of the input speech signal;

wherein the first encoding scheme uses a first frame type for coding the speech signal at a selected rate and the second encoding scheme uses a second frame type for coding the input speech signal at the same selected rate, wherein the second frame type is different from the first frame type;

wherein said first frame type allocates 21 bits for filter coefficient indicators, 1 bit for a type indicator, 14 bits for an adaptive codebook index, 30 bits for a fixed codebook index, 14 bits for an adaptive codebook gain and a fixed codebook gain.

43. A speech encoding system comprising:

a detector for detecting whether an input speech signal generally has a generally voiced and generally stationary characteristic during an interval;

an encoder supporting at least one of a first encoding scheme and a second encoding scheme applicable to the input speech signal for a frame associated with the interval, the second encoding scheme having long-term prediction procedure for processing the inputted speech signal on a sub-frame-by-subframe basis;

a selector for selecting one of the first encoding scheme and the second encoding scheme based upon said detection or absence of the generally voiced and generally stationary characteristic in the interval of the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type;

wherein said first frame type allocates 27 bits for filter coefficient indicators, 1 bit for a type indicator, 26 bits for an adaptive codebook index, 88 bits for a fixed codebook index, and 28 bits for an adaptive codebook gain and a fixed codebook gain.

44. A speech encoding system comprising:

a detector for detecting whether an input speech signal generally has a generally voiced and generally stationary characteristic during an interval;

an encoder supporting at least one of a first encoding scheme and a second encoding scheme applicable to the input speech signal for a frame associated with the interval, the second encoding scheme having long-term prediction procedure for processing the input speech signal on a sub-frame-by-subframe basis;

a selector for selecting one of the first encoding scheme and the second encoding scheme based upon said detection or absence of the generally voiced and generally stationary characteristic in the interval of the input speech signal;

wherein the first encoding scheme uses a first frame type for coding the input speech signal at a selected rate and the second encoding scheme uses a second frame type for coding the input speech signal at the same selected rate, wherein the second frame type is different from the first frame type;

wherein said first frame type allocates 21 bits for filter coefficient indicators, 1 bit for a type indicator, 7 bits for an adaptive codebook index, 39 bits for a fixed codebook index, 4 bits for an adaptive codebook gain, and 8 bits for a fixed codebook gain.

45. The speech encoding system of claim 44, wherein said second frame type allocates 21 bits for said filter coefficient indicators, 1 bit for said type indicator, 14 bits for said adaptive codebook index, 30 bits for said fixed codebook index, 14 bits for said adaptive codebook gain and said fixed codebook gain.

46. A speech encoding system comprising:

a detector for detecting whether an input speech signal generally has a generally voiced and generally stationary characteristic during an interval;

an encoder supporting at least one of a first encoding scheme and a second encoding scheme applicable to the input speech signal for a frame associated with the interval, the second encoding scheme having long-term prediction procedure for processing the input speech signal on a sub-frame-by-subframe basis;

a selector for selecting one of the first encoding scheme and the second encoding scheme based upon said detection or absence of the generally voiced and generally stationary characteristic in the interval of the input speech signal;

wherein the first encoding scheme uses a first frame type for coding the speech signal at a selected rate and the second encoding scheme uses a second frame type for coding the input speech signal at the same selected rate, wherein the second frame type is different from the first frame type;

wherein said first frame type allocates 21 bits for filter coefficient indicators, 1 bit for a type indicator, 14 bits for an adaptive codebook index, 30 bits for said fixed codebook index, 14 bits for an adaptive codebook gain and a fixed codebook gain.

47. A speech encoding method comprising the steps of:

detecting whether an input speech signal has a triggering characteristic during an interval;

selecting one of a first encoding scheme and a second encoding scheme, for application to the input speech signal for a frame associated with the interval, based upon said detection of the triggering characteristic; and processing the input speech signal in accordance with the first encoding scheme to form a revised speech signal biased toward a generally ideal voiced and stationary characteristic if the triggering characteristic is detected in the input speech signal;

wherein the first encoding scheme uses a first frame type for coding the speech signal at a selected rate and the second encoding scheme uses a second frame type for coding the speech signal at the same selected rate, wherein the second frame type is different from the first frame type;

wherein said first frame type allocates 21 bits for filter coefficient indicators, 1 bit for a type indicator, 7 bits for an adaptive codebook index, 39 bits for a fixed codebook index, 4 bits for an adaptive codebook gain, and 8 bits for a fixed codebook gain.

48. The speech encoding method of claim 47, wherein said second frame type allocates 21 bits for said filter coefficient indicators, 1 bit for said type indicator, 14 bits for said adaptive codebook index, 30 bits for said fixed codebook index, 14 bits for said adaptive codebook gain and said fixed codebook gain.

49. A speech encoding method comprising:

receiving a speech frame for encoding;

classifying said speech frame as a voiced speech frame if said speech frame includes a voiced speech component;

designating said voiced speech frame as a stationary voiced speech frame if said voiced speech frame is generally stationary, otherwise, designating said voiced speech frame as a non- stationary voiced speech frame; and allocating a lesser number of bits for an adaptive codebook index of said stationary voiced speech frame than for an adaptive codebook index of said non-stationary voiced speech frame;

allocating a greater number of bits for a fixed codebook index of said stationary voiced speech frame than for a fixed codebook index of said non-stationary voiced speech frame;

determining whether an encoding rate for encoding said speech frame is a high encoding rate or a low encoding rate;

using a first frame type to encode said stationary voiced speech frame if said encoding rate is said high encoding rate;

using a third frame type to encode said stationary voiced speech frame if said encoding rate is said low encoding rate;

wherein said third frame type allocates 21 bits for filter coefficient indicators, 1 bit for a type indicator, 7 bits for said adaptive codebook index, 39 bits for said fixed codebook index, 4 bits for an adaptive codebook gain, and 8 bits for a fixed codebook gain.

50. A speech encoding method comprising:

receiving a speech frame for encoding;

classifying said speech frame as a voiced speech frame if said speech frame includes a voiced speech component;

designating said voiced speech frame as a stationary voiced speech frame if said voiced speech frame is generally stationary, otherwise, designating said voiced speech frame as a non- stationary voiced speech frame; and allocating a lesser number of bits for an adaptive codebook index of said stationary voiced speech frame than for an adaptive codebook index of said non-stationary voiced speech frame;

allocating a greater number of bits for a fixed codebook index of said stationary voiced speech frame than for a fixed codebook index of said non-stationary voiced speech frame;

determining whether an encoding rate for encoding said speech frame is a high encoding rate or a low encoding rate;

using a second frame type to encode said non-stationary voiced speech frame if said encoding rate is said high encoding rate;

using a fourth frame type to encode said non-stationary voiced speech frame if said encoding rate is said low encoding rate;

wherein said second frame type allocates 27 bits for filter coefficient indicators, 1 bit for a type indicator, 26 bits for said adaptive codebook index, 88 bits for said fixed codebook index, and 28 bits for an adaptive codebook gain and a fixed codebook gain.

51. The speech encoding method of claim 50, wherein said fourth frame type allocates 21 bits for said filter coefficient indicators, 1 bit for said type indicator, 14 bits for said adaptive codebook index, 30 bits for said fixed codebook index, 14 bits for said adaptive codebook gain and said fixed codebook gain.

52. A speech encoding method comprising:

receiving a speech frame for encoding;

classifying said speech frame as a voiced speech frame if said speech frame includes a voiced speech component;

designating said voiced speech frame as a stationary voiced speech frame if said voiced speech frame is generally stationary, otherwise, designating said voiced speech frame as a non-stationary voiced speech frame; and allocating a lesser number of bits for an adaptive codebook index of said stationary voiced speech frame than for an adaptive codebook index of said non-stationary voiced speech frame;

allocating a greater number of bits for a fixed codebook index of said stationary voiced speech frame than for a fixed codebook index of said non-stationary voiced speech frame;

determining whether an encoding rate for encoding said speech frame is a high encoding rate or a low encoding rate;

using a second frame type to encode said non-stationary voiced speech frame if said encoding rate is said high encoding rate;

using a fourth frame type to encode said non-stationary voiced speech frame if said encoding rate is said low encoding rate;

wherein said fourth frame type allocates 21 bits for filter coefficient indicators, 1 bit for a type indicator, 14 bits for said adaptive codebook index, 30 bits for said fixed codebook index, 14 bits for an adaptive codebook gain and a fixed codebook gain.

53. A speech encoding system comprising:

a receiver configured to receive a speech frame for encoding;

a classifier configured to classify said speech frame as a voiced speech frame if said speech frame includes a voiced speech component, said classifier further configured to designate said voiced speech frame as a stationary voiced speech frame if said voiced speech frame is generally stationary, otherwise, said classifier designates said voiced speech frame as a non-stationary voiced speech frame; and an encoder configured to allocate a lesser number of bits for an adaptive codebook index of said stationary voiced speech frame than for an adaptive codebook index of said non-stationary voiced speech frame;

wherein said encoder is further configured to allocate a greater number of bits for a fixed codebook index of said stationary voiced speech frame than for a fixed codebook index of said non-stationary voiced speech frame;

wherein said encoder is further configured to: determine whether an encoding rate for encoding said speech frame is a high encoding rate or a low encoding rate, use a first frame type to encode said stationary voiced speech frame if said encoding rate is said high encoding rate, and use a third frame type to encode said stationary voiced speech frame if said encoding rate is said low encoding rate;

wherein said third frame type allocates 21 bits for filter coefficient indicators, 1 bit for a type indicator, 7 bits for said adaptive codebook index, 39 bits for said fixed codebook index, 4 bits for an adaptive codebook gain, and 8 bits for a fixed codebook gain.

54. A speech encoding system comprising:

a receiver configured to receive a speech frame for encoding;

a classifier configured to classify said speech frame as a voice speech frame if said speech frame includes a voiced speech component, said classifier further configured to designate said voiced speech frame as a stationary voiced speech frame if said voice speech frame is generally stationary, otherwise, said classifier designates said voiced speech fame as a non- stationary voiced speech frame; and an encoder configured to allocate a lesser number of bits for an adaptive codebook index of said stationary voiced speech frame than for an adaptive codebook index of said non- stationary voiced speech frame;

wherein said encoder is further configured to allocate a greater number of bits for a fixed codebook index of said stationary voiced speech frame than for a fixed codebook index of said non-stationary voiced speech frame;

wherein said encoder is further configured to: determine whether an encoding rate for encoding said speech frame is a high encoding rate or a low encoding rate, use a second frame type to encoding said non-stationary voice speech frame if said encoding rate is said high encoding rate, and use a fourth frame type to encode said non-stationary voice speech frame if said encoding rate is said low encoding rate;

wherein said second frame type allocates 27 bits for filter coefficient indicators, 1 bit for a type indicator, 26 bits for said adaptive codebook index, 88 bits for said fixed codebook index, and 28 bits for an adaptive codebook gain and a fixed codebook gain.

55. The speech encoding system of claim 54, wherein said fourth frame type allocate 21 bits for said filter coefficient indicators, 1 for said type indicator, 14 bits for said adaptive codebook index, 30 bits for said fixed codebook index, 14 bits for said adaptive codebook gain and said fixed codebook gain.

56. A speech encoding system comprising:

a receiver configured to receive a speech frame for encoding;

a classifier configured to classify said speech frame as a voiced speech frame if said speech frame includes a voiced speech component, said classifier further configured to designate said voiced speech frame as a stationary voiced speech frame if said voiced speech frame is generally stationary, otherwise, said classifier designates said voiced speech frame as a non- stationary voice speech frame; and an encoder configured to allocate a lesser number of bits for an adaptive codebook index of said stationary voiced speech frame than for an adaptive codebook index of said non- stationary voiced speech frame;

wherein said encoder is further configured to allocate a greater number of bits for a fixed codebook index of said stationary voiced speech frame than for a fixed codebook index of said non-stationary speech frame;

wherein said encoder is further configured to: determine whether an encoding rate for encoding said speech frame is a high encoding rate or a low encoding rate, use a second frame type to encode said non-stationary voice speech frame if said encoding rate is said high encoding rate, and use a fourth frame type to encode said non-stationary voiced speech frame if said encoding rate is said low encoding rate;

wherein said fourth frame type allocates 21 bits filter coefficient indicators, 1 bit for a type indicator, 14 bits for said adaptive codebook index, 30 bits for fixed codebook index, 14 bits for an adaptive codebook gain and a fixed codebook gain.

57. The speech encoding system of claim 1, wherein said second frame type allocates 27 bits for filter coefficient indicators, 1 bit for said type indicator, 26 bits for said adaptive codebook index, 88 bits for said fixed codebook index, and 28 bits for said adaptive codebook gain and said fixed codebook gain.

* * * * *

UNITED STATES PATENT AND TRADEMARK OFFICE

CERTIFICATE OF CORRECTION

PATENT NO. : 7,072,832 B1
APPLICATION NO. : 09/663002
DATED : July 4, 2006
INVENTOR(S) : Su et al.

It is certified that error appears in the above-identified patent and that said Letters Patent is hereby corrected as shown below:

In the claims, column 19, line 65, “is different from the first frame type” should be deleted.

In the claims, column 22, line 36, “inputted” should be changed to --input--.

In the claims, column 22, line 50, “said” should be deleted.

In the claims, column 22, line 36, “inputt” should be changed to --input--.

In the claims, column 23, line 51, “voice” should be changed to --voiced--.

In the claims, column 24, line 7, “said for” should be changed to --for said--.

In the claims, column 24, line 22, --and;
An encoder configured to allocate a lesser number of bits for an adaptive codebook index of said stationary voice speech frame than for an adaptive codebook index of said non-stationary voiced speech frame;-- should be inserted between --frame;-- and --wherein--.

In the claims, column 24, line 38, “indes” should be changed to --index--.

In the claims, column 27, line 18, “said” should be changed to --a--.

In the claims, column 29, line 57, “voice” should be changed to --voiced--.

In the claims, column 29, line 60, “voice” should be changed to --voiced--.

UNITED STATES PATENT AND TRADEMARK OFFICE

CERTIFICATE OF CORRECTION

PATENT NO. : 7,072,832 B1
APPLICATION NO. : 09/663002
DATED : July 4, 2006
INVENTOR(S) : Su et al.

It is certified that error appears in the above-identified patent and that said Letters Patent is hereby corrected as shown below:

In the claims, column 30, line 9, “encoding” should be changed to --encode--.

Signed and Sealed this

Eighteenth Day of March, 2008

JON W. DUDAS
*Director of the United States Patent and Trademark Office*